US008792816B2

(12) United States Patent
Sato

(10) Patent No.: US 8,792,816 B2
(45) Date of Patent: Jul. 29, 2014

(54) IMAGE-FORMING DEVICE HAVING PHOTOSENSITIVE DRUMS AND ENDLESS BELT

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 13/362,653

(22) Filed: Jan. 31, 2012

(65) Prior Publication Data

US 2012/0213547 A1 Aug. 23, 2012

(30) Foreign Application Priority Data

Feb. 21, 2011 (JP) ..... 2011-034347

(51) Int. Cl.
*G03G 15/16* (2006.01)

(52) U.S. Cl.
USPC ..... 399/358

(58) Field of Classification Search
USPC ..... 399/116, 113, 114, 115, 35, 120
See application file for complete search history.

(56) References Cited

U.S. PATENT DOCUMENTS

| | | | | |
|---|---|---|---|---|
| 4,138,687 | A * | 2/1979 | Cha et al. | 347/75 |
| 5,608,501 | A | 3/1997 | Makino | |
| 5,842,091 | A | 11/1998 | Nakano | |
| 8,315,537 | B2 | 11/2012 | Miyahara et al. | |
| 8,369,745 | B2 | 2/2013 | Sato | |
| 2004/0009009 | A1 * | 1/2004 | Beaufort | 399/120 |
| 2006/0204249 | A1 * | 9/2006 | Sugiyama | 399/12 |
| 2006/0257163 | A1 | 11/2006 | Sato | |
| 2007/0183814 | A1 | 8/2007 | Kamimura | |
| 2008/0279581 | A1 | 11/2008 | Shimizu | |
| 2009/0035014 | A1 | 2/2009 | Sato | |
| 2009/0136259 | A1 | 5/2009 | Ito | |
| 2009/0154973 | A1 | 6/2009 | Shimizu et al. | |
| 2009/0285593 | A1 * | 11/2009 | Sakuma | 399/71 |

(Continued)

FOREIGN PATENT DOCUMENTS

| | | |
|---|---|---|
| JP | S61-129665 A | 6/1986 |
| JP | S62-116970 A | 5/1987 |

(Continued)

OTHER PUBLICATIONS

JP_2010008472_A_H Machine Translation.*

(Continued)

*Primary Examiner* — Clayton E Laballe
*Assistant Examiner* — Victor Verbitsky
(74) *Attorney, Agent, or Firm* — Baker Botts L.L.P.

(57) ABSTRACT

In an image-forming device, photosensitive drums are held by the holding member. Developer material accommodating units are held by the holding member so as to form a row of developer material accommodating units along an alignment direction, the developer material accommodating units including one end developer material accommodating unit that is located at one end of the row of developer material accommodating units. An endless belt extends in the alignment direction. A waste developer material accommodating part is provided integrally with the one end developer material accommodating part. A waste developer material conveying mechanism conveys waste developer material from a recovering unit to the waste developer material accommodating part. The holding member includes: a first side plate and a second side plate; and a first beam and a second beam, at least part of a waste developer material conveying mechanism being provided on the first beam.

13 Claims, 23 Drawing Sheets

(56) References Cited

U.S. PATENT DOCUMENTS

| | | | | |
|---|---|---|---|---|
| 2009/0324284 | A1* | 12/2009 | Ohta | 399/120 |
| 2010/0028041 | A1 | 2/2010 | Sakuma | |
| 2010/0080600 | A1* | 4/2010 | Okamoto et al. | 399/71 |
| 2010/0080615 | A1 | 4/2010 | Kikuchi | |
| 2010/0209157 | A1 | 8/2010 | Sato et al. | |
| 2010/0272467 | A1 | 10/2010 | Sato | |
| 2012/0213566 | A1 | 8/2012 | Sato | |
| 2012/0213567 | A1 | 8/2012 | Sato et al. | |

FOREIGN PATENT DOCUMENTS

| | | | |
|---|---|---|---|
| JP | S63-073776 | U | 5/1988 |
| JP | H03-051455 | U | 5/1991 |
| JP | H05-232845 | A | 9/1993 |
| JP | H06-015066 | U | 2/1994 |
| JP | H06-021050 | U | 3/1994 |
| JP | H07-225514 | A | 8/1995 |
| JP | H09-319207 | A | 12/1997 |
| JP | H10-333520 | A | 12/1998 |
| JP | 2000-098841 | A | 4/2000 |
| JP | 2006-343359 | A | 12/2006 |
| JP | 2007-178654 | A | 7/2007 |
| JP | 2008-224820 | A | 9/2008 |
| JP | 2008-276137 | A | 11/2008 |
| JP | 2009-128754 | A | 6/2009 |
| JP | 2009-276438 | A | 11/2009 |
| JP | 2010008472 | A * | 1/2010 |
| JP | 2010-038947 | A | 2/2010 |
| JP | 2010-102285 | A | 5/2010 |
| JP | 2010-122245 | A | 6/2010 |
| JP | 2010-151996 | A | 7/2010 |
| JP | 2010-191012 | A | 9/2010 |
| JP | 2010-191013 | A | 9/2010 |
| JP | 2010-256827 | A | 11/2010 |
| JP | 2011-017939 | A | 1/2011 |
| JP | 2012-173454 | A | 9/2012 |
| JP | 2012-173456 | A | 9/2012 |
| JP | 2012-173457 | A | 9/2012 |

OTHER PUBLICATIONS

Japan Patent Office, Notification of Reason for Refusal in counterpart Patent Application No. JP 2011-034346 (dispatch date Feb. 5, 2013).

United States Patent and Trademark Office, Notice of Allowance for U.S. Appl. No. 13/362,356 (related to above-captioned patent application), mailed Oct. 29, 2013.

United States Patent and Trademark Office, Office Action for U.S. Appl. No. 13/363,113 (related to above-captioned patent application), mailed Nov. 13, 2013.

* cited by examiner

IMAGE-FORMING DEVICE HAVING PHOTOSENSITIVE DRUMS AND ENDLESS BELT

CROSS REFERENCE TO RELATED APPLICATION

This application claims priority from Japanese Patent Application No. 2011-034347 filed Feb. 21, 2011. The entire content of this priority application is incorporated herein by reference.

TECHNICAL FIELD

The present invention relates to an image-forming device, such as a color printer.

BACKGROUND

One type of image-forming device is equipped with photosensitive drums arranged in tandem and parallel to one another. Four photosensitive drums are typically provided for the four colors yellow, magenta, cyan, and black. The image-forming device also has an endless conveying belt disposed in contact with all photosensitive drums for conveying sheets of paper so that the sheets sequentially contact each of the photosensitive drums. Toner images formed on the photosensitive drums are transferred onto the sheet of paper conveyed by the conveying belt, forming a color image on the paper with the superposed images of each color.

Toner is transferred from the photosensitive drums to the conveying belt. In a conventional image-forming device, a cleaning unit is provided to remove toner from the conveying belt. The cleaning unit is provided with a waste toner accommodating unit for accommodating toner (waste toner) removed from the conveying belt.

SUMMARY

An object of the present invention is to provide an improved image-forming device.

In order to attain the above and other objects, the invention provides an image-forming device, including: a holding member; a plurality of photosensitive drums; a plurality of developer material accommodating units; an endless belt; a recovering unit; a waste developer material accommodating part; and a waste developer material conveying mechanism. The plurality of photosensitive drums are held by the holding member, are juxtaposed with one another in an alignment direction, and are arranged spaced apart from one another to form a row of photosensitive drums along the alignment direction. The plurality of developer material accommodating units are held by the holding member in one to one correspondence with the plurality of photosensitive drums so as to form a row of developer material accommodating units along the alignment direction and are configured to accommodate developer material to be supplied to the photosensitive drums, the developer material accommodating units including one end developer material accommodating unit that is located at one end of the row of developer material accommodating units. The endless belt extends in the alignment direction and confronts all of the plurality of photosensitive drums at the same time. The recovering unit is held by the holding member and is configured to remove, from the belt, waste developer material to be discarded from the belt and collect the waste developer material. The waste developer material accommodating part is provided integrally with the one end developer material accommodating part and is configured to accommodate waste developer material collected by the recovering unit. The waste developer material conveying mechanism is configured to be connected to both of the recovering unit and the waste developer material accommodating part and to convey the waste developer material from the recovering unit to the waste developer material accommodating part. The holding member includes: a first side plate and a second side plate that are disposed on a pair of opposite sides of the photosensitive drums along an axial direction of the photosensitive drums and that confront with each other along the axial direction; and a first beam and a second beam that are disposed on a pair of opposite sides of the photosensitive drums along the alignment direction and that span between the first and second side plates, at least part of the waste developer material conveying mechanism being provided on the first beam.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, embodiments of the present invention will be described while referring to the accompanying drawings.

1. Color Printer

Figure 1:
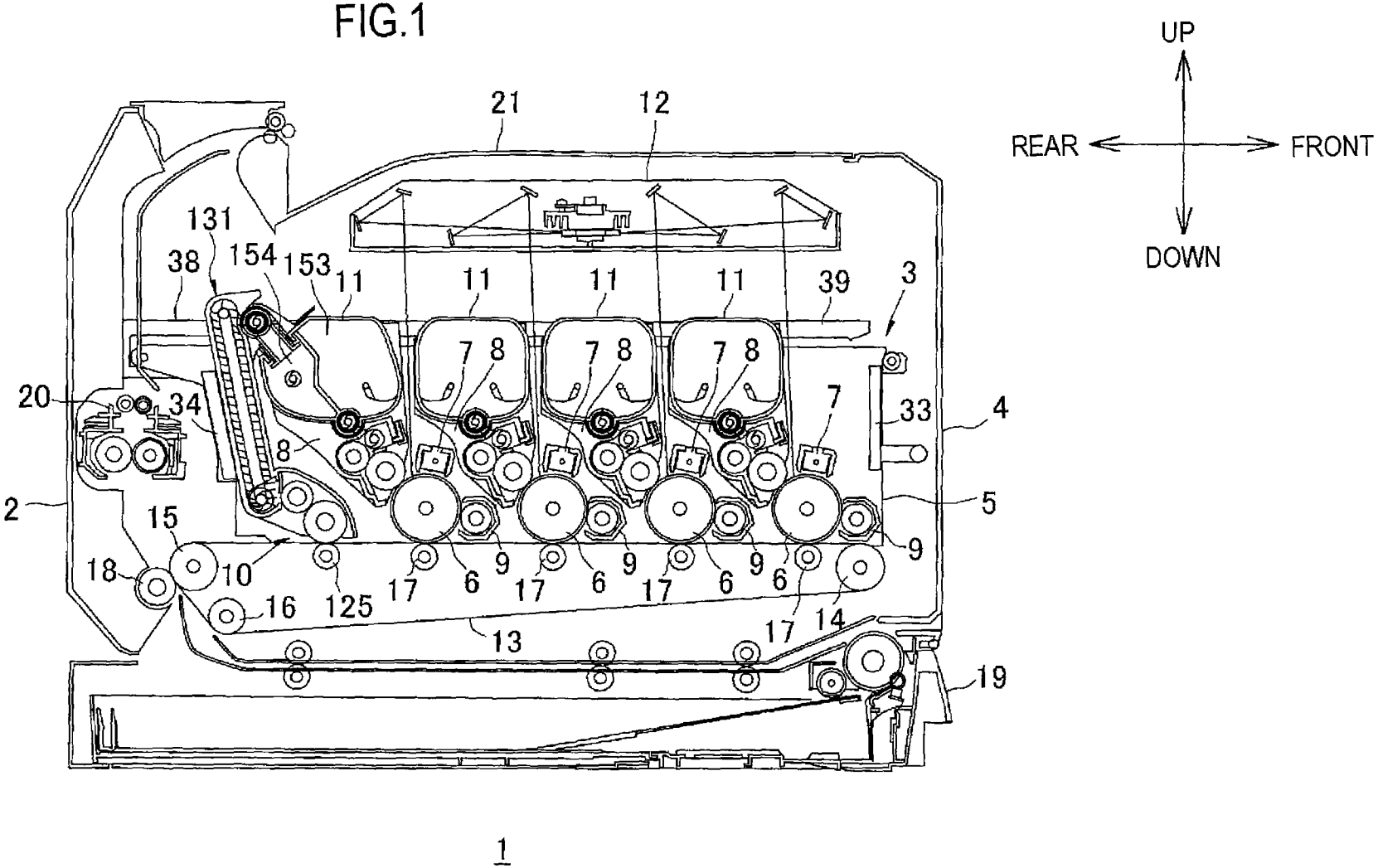
FIG. 1 is a cross-sectional view of a color printer according to an embodiment of the present invention, in which a drawer unit is in an accommodated position.
Figure 2A:
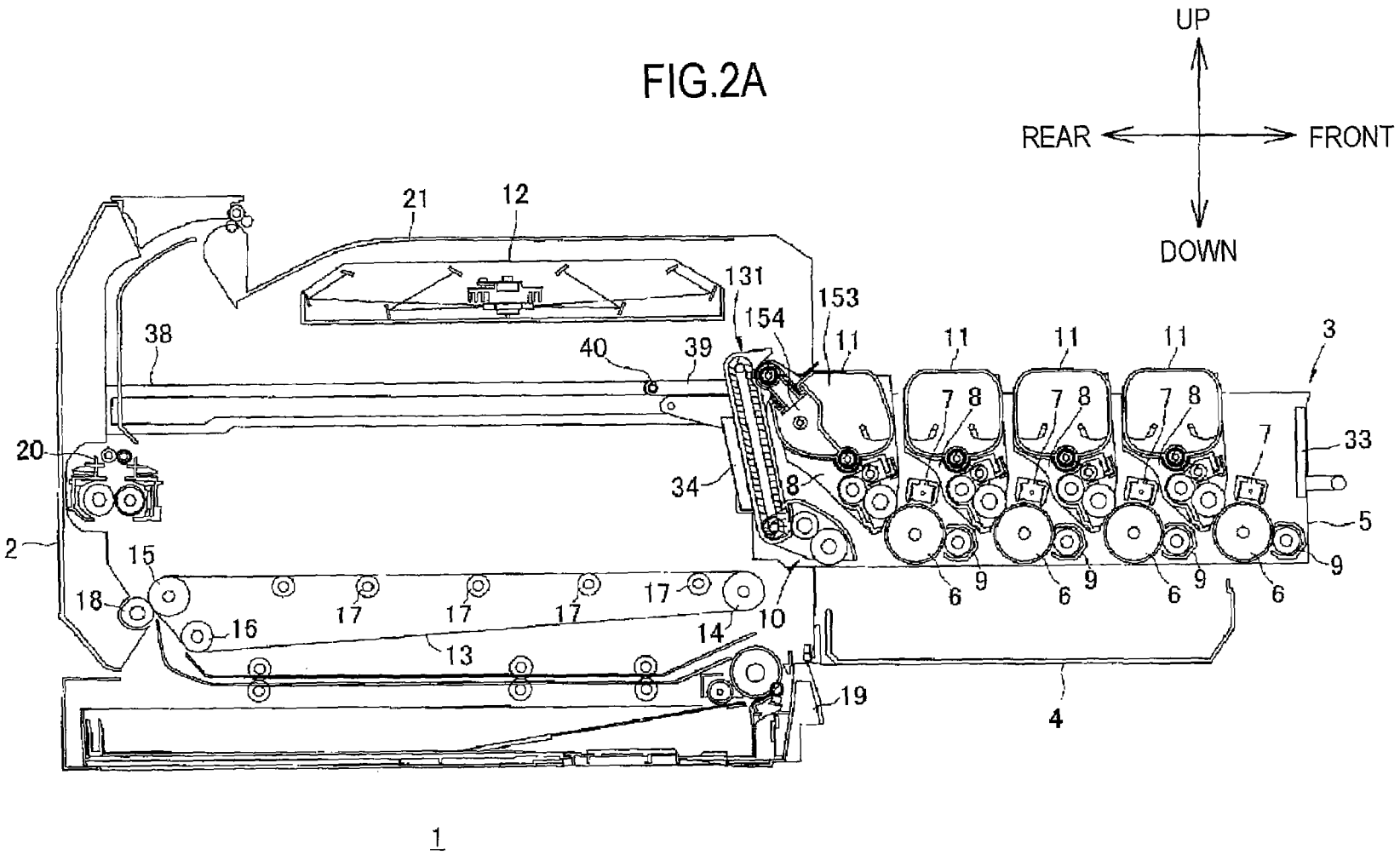
FIG. 2A is a cross-sectional view of the color printer of FIG. 1, in which the drawer unit is in a pulled-out position.
Figure 2B:
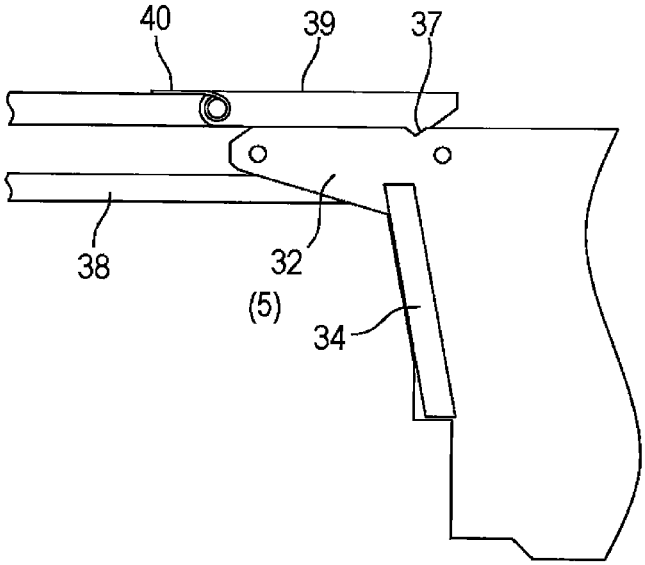
FIG. 2B illustrates how an engaging protrusion formed on a stopper arm is fitted into an engagement groove of a drawer frame when the drawer unit is in the pulled-out position, wherein showing of a rear conveying unit is omitted.
Figure 3:
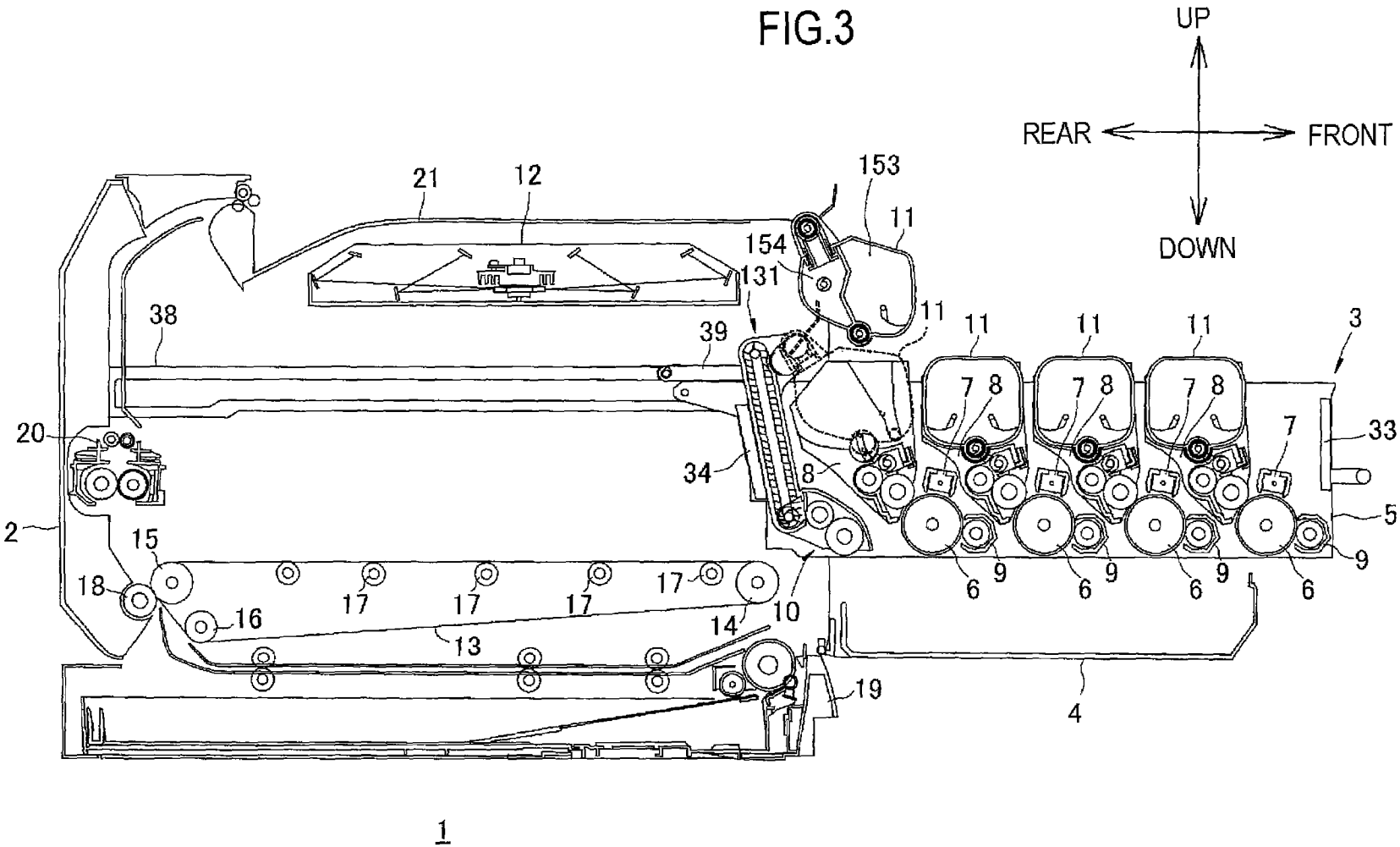
FIG. 3 is a cross-sectional view of the color printer of FIG. 1, in which the drawer unit is in the pulled-out position and a black toner unit is detached from the drawer unit.

As shown in FIGS. 1, 2, and 3, the image-forming device according to the embodiment is a tandem-type color printer 1. The color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2 (the position shown in FIG. 1) and a pulled-out position outside the main casing 2 (the position shown in FIG. 2A). In the pulled-out position, part of the drawer unit 3 remains inside the main casing 2, while the top of the drawer unit 3 outside the main casing 2 is exposed to reveal four toner units 11 (described later) mounted therein.

In the following description, the side of the color printer 1 on which the front cover 4 is provided (the side that a user faces when operating the color printer 1) will be considered the front side of the color printer 1 relative to a front-to-rear direction. A direction orthogonal to a flat surface on which the color printer 1 rests will be considered the vertical (an up-to-down direction). The left and right sides of the color printer 1 are defined based on the reference of a user facing the front side of the color printer 1 when the color printer 1 rests on a flat surface.

The drawer unit 3 is provided with a drawer frame 5. Four photosensitive drums 6 are rotatably retained in the drawer frame 5. More specifically, the photosensitive drums 6 are retained in the drawer frame 5 so that the peripheral surfaces of the photosensitive drums 6 are capable of circulating about axes extending in the left-to-right direction. The four photosensitive drums 6 are respectively provided for the colors black, yellow, magenta, and cyan and are arranged at regular intervals along the front-to-rear direction from the rear to the front according to the order of colors given above. In other words, the photosensitive drums 6 are juxtaposed with one another and are arranged spaced apart from one another by the same gap in the front-to-rear direction.

The drawer frame 5 also retains four chargers 7, four developing units 8, and four drum cleaners 9 for the four colors black, yellow, magenta, and cyan. One each of the chargers 7, developing units 8, and drum cleaners 9 is arranged circumferentially around the corresponding photosensitive drum 6. The chargers 7 are disposed above the corresponding photosensitive drums 6. The developing units 8 are disposed diagonally above and rearward of the corresponding photosensitive drums 6. The drum cleaners 9 are disposed on the front of the corresponding photosensitive drums 6.

The drawer frame 5 also retains a belt cleaner 10.

Four toner units 11 are detachably retained in the drawer frame 5 at positions above the corresponding developing units 8. The toner units 11 supply toner to the developing units 8. As illustrated in FIG. 3, the toner units 11 are detachably mounted in the top of the drawer frame 5 while the drawer unit 3 is in the pulled-out position.

An exposure device 12 is provided in the uppermost section of the main casing 2. The exposure device 12 irradiates four laser beams corresponding to the four colors used by the color printer 1.

During an image-forming operation, the photosensitive drums 6 rotate counterclockwise in a left side view. As each photosensitive drum 6 rotates, the corresponding charger 7 applies a uniform charge to the surface of the photosensitive drum 6 through corona discharge. Subsequently, the exposure device 12 irradiates laser beams for selectively exposing the surfaces of the photosensitive drums 6. This exposure removes charge from the surfaces of the photosensitive drums 6, forming electrostatic latent images thereon. The corresponding developing units 8 then supply toner to develop the latent images into toner images.

An intermediate transfer belt 13 is provided inside the main casing 2 at a position slightly below the vertical center of the main casing 2. The intermediate transfer belt 13 is an endless belt and is looped about three rollers 14, 15, and 16. The rollers 14 and 15 are disposed in approximately the same vertical position, but are spaced apart in the front-to-rear direction. The remaining roller 16 is located on the front lower side of the rear side roller 15. By placing the intermediate transfer belt 13 around the rollers 14-16, the upper portion of the belt loop between the top edges of the rollers 14 and 15 forms a flat portion that extends in both front-to-rear and left-to-right directions. This flat portion contacts the four photosensitive drums 6.

Primary transfer rollers 17 are disposed inside the loop of the intermediate transfer belt 13 at positions confronting corresponding photosensitive drums 6 through the flat portion of the intermediate transfer belt 13.

During an image-forming operation, the intermediate transfer belt 13 circulates clockwise in a left side view. Toner images formed on the surfaces of the photosensitive drums 6 are sequentially transferred, beginning from the black toner image, and superposed on the intermediate transfer belt 13 through the function of the primary transfer rollers 17, forming a color toner image on the intermediate transfer belt 13 from the superposed toner images.

A secondary transfer roller 18 is disposed in confrontation with the rear side roller 15 through the intermediate transfer belt 13. The secondary transfer roller 18 contacts the intermediate transfer belt 13.

A sheet cassette 19 accommodating sheets of paper is disposed in a bottom section of the main casing 2. Various rollers are provided for conveying sheets of paper from the sheet cassette 19 to the position where the intermediate transfer belt 13 contacts the secondary transfer roller 18. Through the function of the secondary transfer roller 18, the toner images formed on the intermediate transfer belt 13 are transferred onto the sheets of paper that are passing between the intermediate transfer belt 13 and secondary transfer roller 18.

A fixing unit 20 is positioned on the rear side of the drawer frame 3 when the drawer frame 3 is located in the accommodated position. Sheets of paper are conveyed to the fixing unit 20 after toner images have been transferred onto the sheets. The fixing unit 20 fixes the toner images to the sheets of paper with heat and pressure. Once the toner images have been fixed in the fixing unit 20, various rollers discharge the sheets into a discharge tray 21 formed on the top surface of the main casing 2.

2. Drawer Unit 2-1. Drawer Frame

Figure 4:
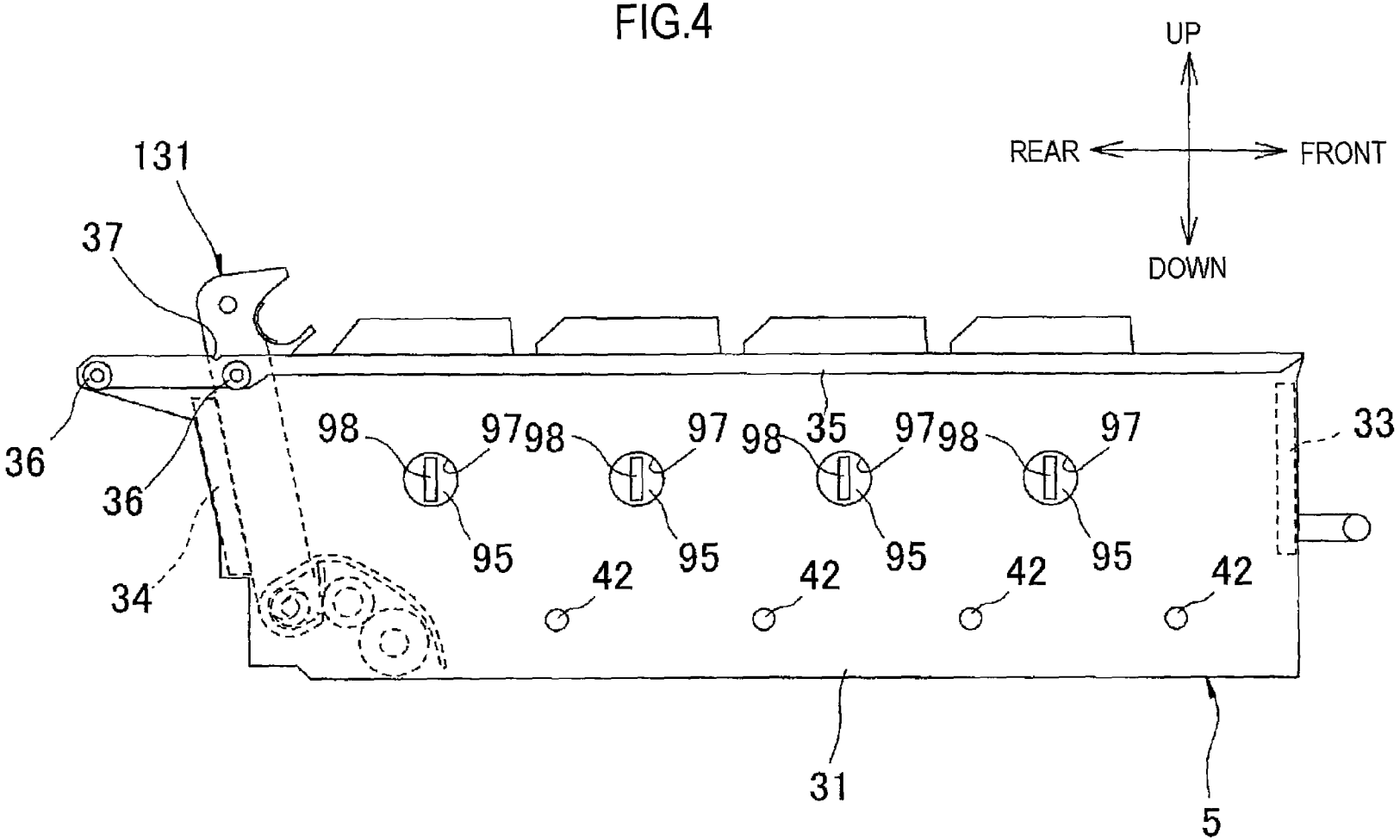
FIG. 4 is a left side view of the drawer unit, in which operating knobs are aligned in the vertical direction (developing-unit-side shutters are in a closed position)
Figure 5:
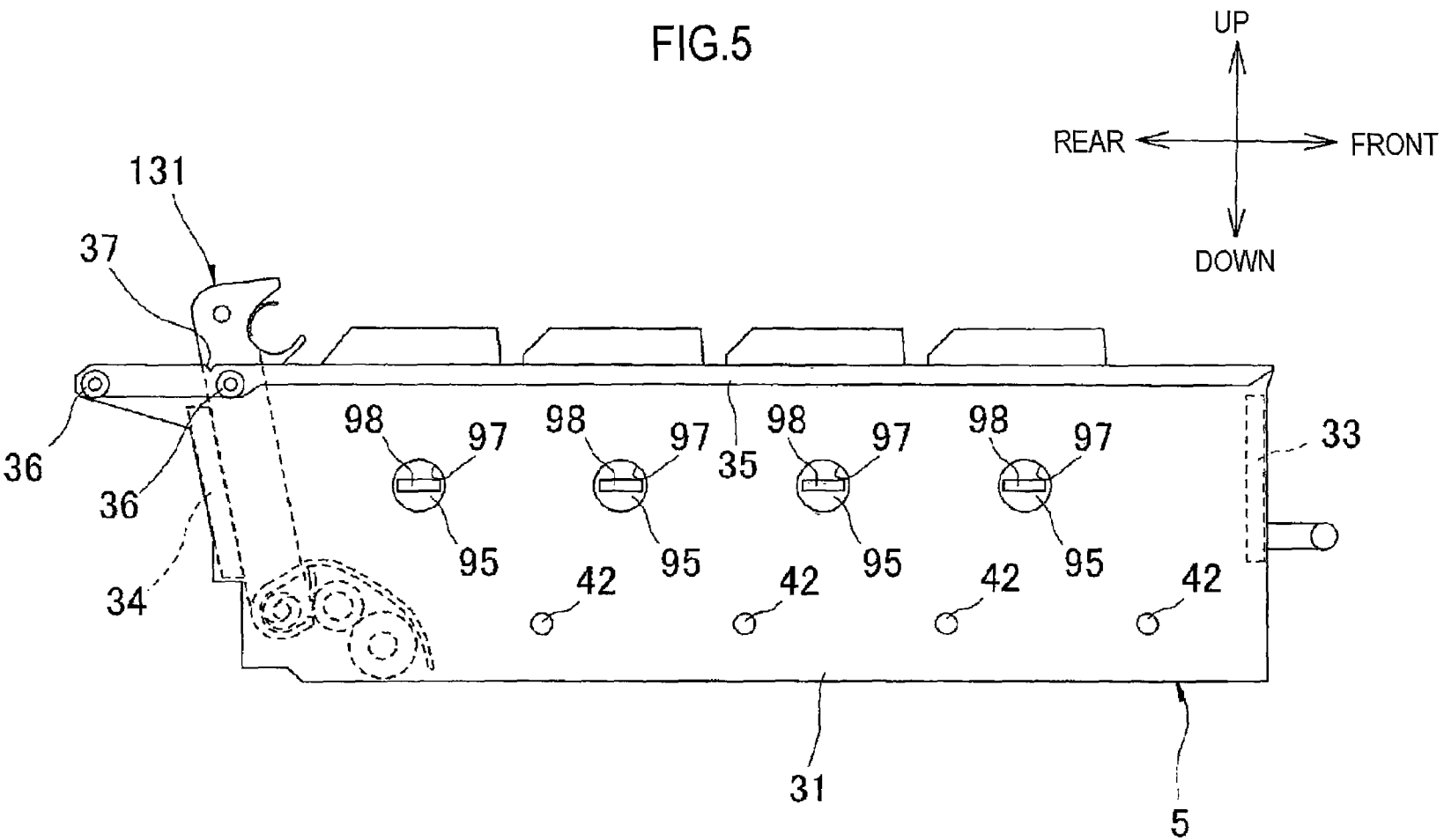
FIG. 5 is a left side view of the drawer unit, in which the operating knobs are aligned in the front-to-rear direction (the developing-unit-side shutters are in an open position)
Figure 6:
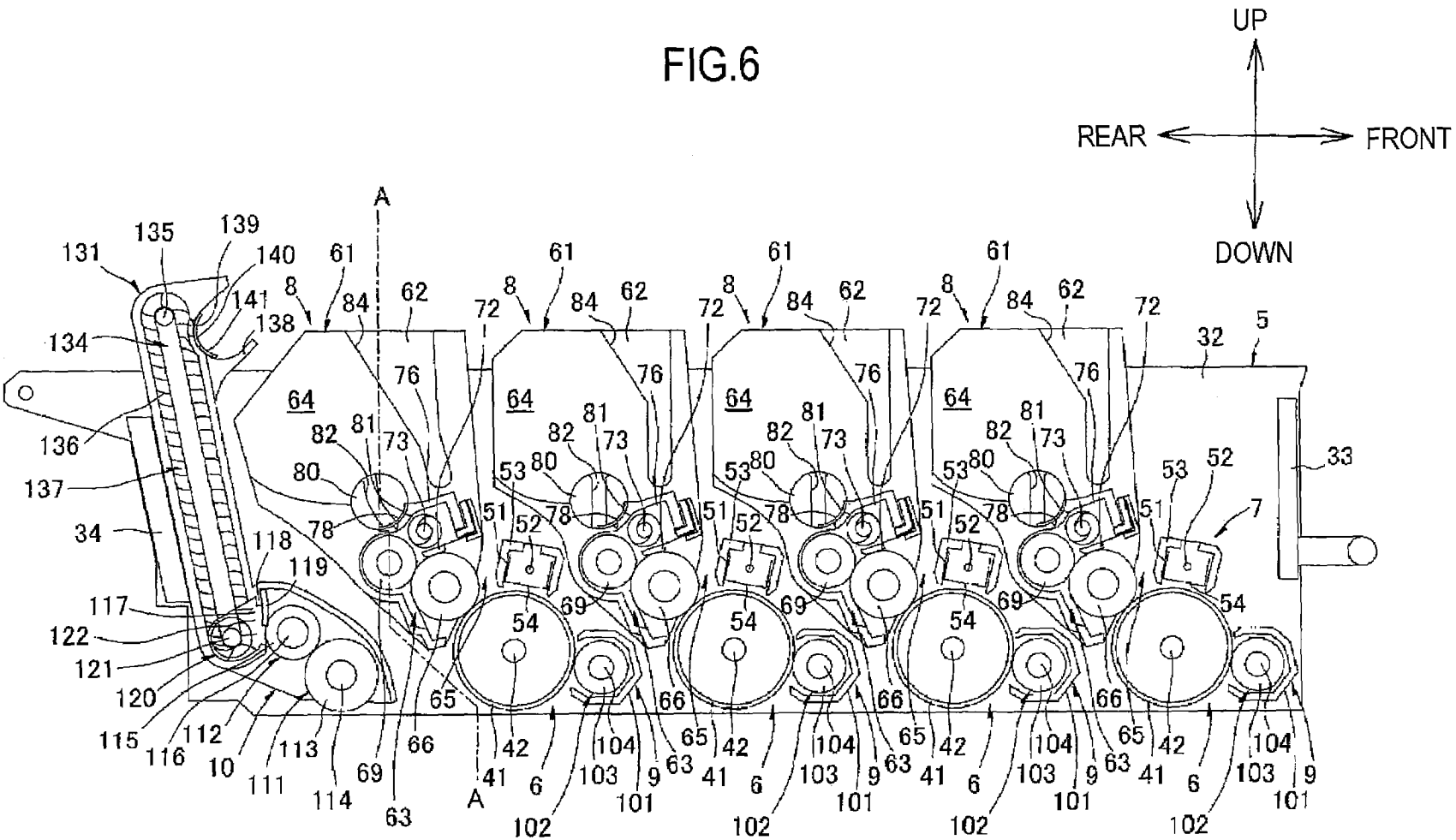
FIG. 6 is a cross-sectional view of the drawer unit, in which the developing-unit-side shutters are in a closed position.
Figure 7:
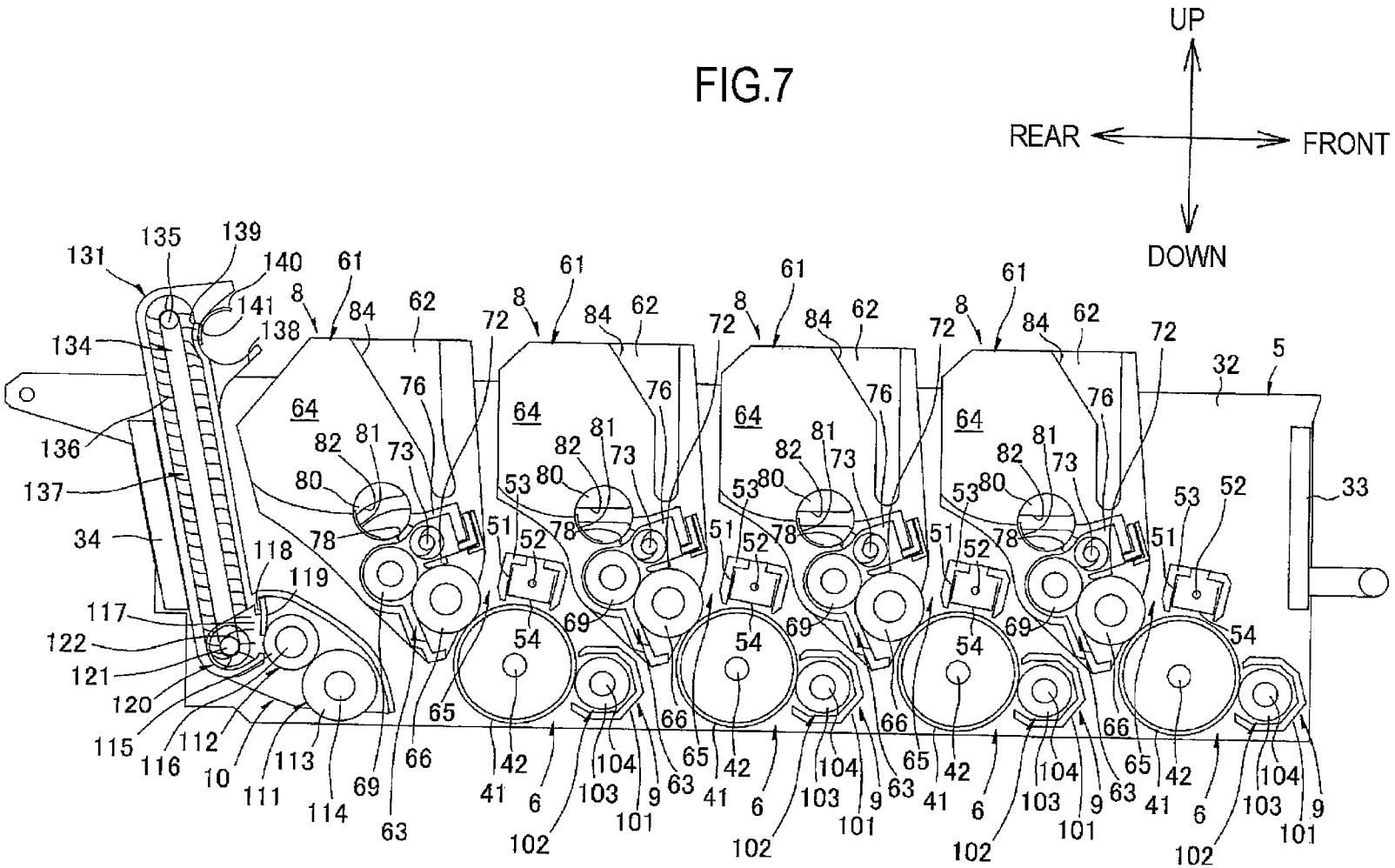
FIG. 7 is a cross-sectional view of the drawer unit, in which the developing-unit-side shutters are in an open position.

The drawer frame 5 is configured of a left side plate 31 shown in FIGS. 4 and 5, and a right side plate 32 shown in FIGS. 6 and 7. As shown in FIG. 10, the side plates 31 and 32 are arranged parallel to each other and separated in the left-to-right direction. As shown in FIGS. 4 through 9, the drawer frame 5 also includes a front beam 33 bridging the front ends of the side plates 31 and 32, and a rear beam 34 bridging the rear ends of the side plates 31 and 32.

As shown in FIG. 10, a guided part 35 is formed on the outer surface of each of the side plates 31 and 32. The guided parts 35 are formed as ridges extending along the top edges of the side plates 31 and 32. Each guided part 35 extends rearward to a position farther rearward than the rear beam 34. As shown in FIGS. 4 and 5, two rollers 36 arranged parallel to each other and separated in the front-to-rear direction are rotatably mounted in the rear end portion of each guided part 35. An engagement groove 37 is formed in the top surface of each guided part 35 at a position slightly rearward of the front roller 36. The engagement grooves 37 are V-shaped in a side view.

As shown in FIG. 2A, guide parts 38 are provided in the main casing 2. The guided parts 35 are guided within the respective guide parts 38 as the drawer unit 3 is moved into and out of the main casing 2. The guide parts 38 are positioned below the exposure device 12 and extend in the front-to-rear direction. In a side view, the guide parts 38 have an angular C-shape that is elongated in the front-to-rear direction and open on the front side. The bottom portion of the guide parts 38 is a step lower near the rear end. The lower stepped portion of the guide part 38 is longer than the interval between the two rollers 36. As shown in FIGS. 1-2B, a stopper arm 39 is attached to the front end of each guide part 38 on the upper portion thereof. The stopper arms 39 extend in the front-to-rear direction and are pivotably disposed on the guide parts 38 so that their front ends can move up and down. As shown in FIG. 2A, springs 40 urge the front ends of the respective stopper arms 39 downward. An engaging protrusion is formed on the front end of each stopper arm 39. The engaging protrusions are V-shaped in a side view and protrude downward.

When the drawer unit 3 is in the accommodated position, the guided parts 35 are positioned inside the guide parts 38 (between the upper portion and lower portion of the guide parts 38), and the rear rollers 36 are in contact with the rear ends of the guide parts 38. Further, the rollers 36 are positioned on the lower stepped portion of the guide parts 38. In this state, the photosensitive drums 6 are in contact with the intermediate transfer belt 13.

When the drawer unit 3 is moved from the accommodated position to the pulled-out position, the rollers 36 roll over the bottom portion of the guide parts 38, while the guided parts 35 remain supported on the bottom portion of the guide parts 38. The engaging protrusions of the stopper arms 39 are in contact with the top surfaces of the guided parts 35. When the rollers 36 leave the lower stepped portion of the guide parts 38, the drawer unit 3 rises a distance equal to the height of the step in the lower portion of the guide parts 38, causing the photosensitive drums 6 to rise up off the intermediate transfer belt 13.

When the drawer unit 3 reaches the pulled-out position shown in FIG. 2A, the engaging protrusions formed on the stopper arms 39 become fitted into the respective engagement grooves 37 of the guided parts 35 as shown in FIG. 2B. This engagement fixes the drawer unit 3 relative to the main casing 2 with adequate firmness so that the drawer unit 3 is maintained in the pulled-out position.

2-2. Photosensitive Drums

As shown in FIGS. 6 through 9, each photosensitive drum 6 includes a cylindrical main drum body 41, and a drum shaft 42. The drum shaft 42 extends through the axial center of the main drum body 41 and protrudes from both ends of the same.

The main drum body 41 is rotatably supported on the drum shaft 42. While being aligned in the left-to-right direction, the drum shaft 42 is inserted into the side plates 31 and 32 and is fixed so as to be incapable of rotating relative to the side plates 31 and 32. Hence, the photosensitive drums 6 are rotatably disposed so that the peripheral surfaces of the main drum bodies 41 circulate. As shown in FIG. 10, a drum gear 43 is mounted on the left end of the main drum body 41 and is non-rotatable relative to the same. A motor (not shown) inputs a drive force into the drum gear 43.

Alternatively, the main drum body 41 may be non-rotatably supported on the drum shaft 42, the drum shaft 42 may be rotatably supported in the side plates 31 and 32, and the drum gear 43 may be fixed to the drum shaft 42.

2-3. Chargers

As shown in FIGS. 6 through 9, the chargers 7 are held in charger retaining units 51. Each charger retaining unit 51 spans between the side plates 31 and 32 at a position above the corresponding photosensitive drum 6. The charger retaining units 51 have a substantially angular C-shape in cross section that is open on the photosensitive drum 6 side. Each charger 7 includes a discharge wire 52 extending in the left-to-right direction within the charger retaining unit 51, and a shielding case 53 for covering the open side of the charger retaining unit 51. The shielding case 53 has a substantially angular C-shape in cross section that is open on the side opposite the photosensitive drum 6. When a high voltage is applied to the discharge wire 52, the discharge wire 52 produces a corona discharge to charge the surface of the photosensitive drum 6. A grid electrode 54 is formed on the surface of the shielding case 53 opposing the photosensitive drum 6 for regulating the amount of charge that is applied to the photosensitive drum 6.

2-4. Developing Units

As shown in FIGS. 6, 7, 10, 11, and 12, each developing unit 8 has a case 61. The case 61 includes a pair of side plates 62 arranged parallel to each other and separated in the left-to-right direction. As shown in FIGS. 6, 7, 11, and 12, a developing chamber 63 and a mounting space 64 for receiving a corresponding toner unit 11 are formed between the left and right side plates 62.

Figure 11:
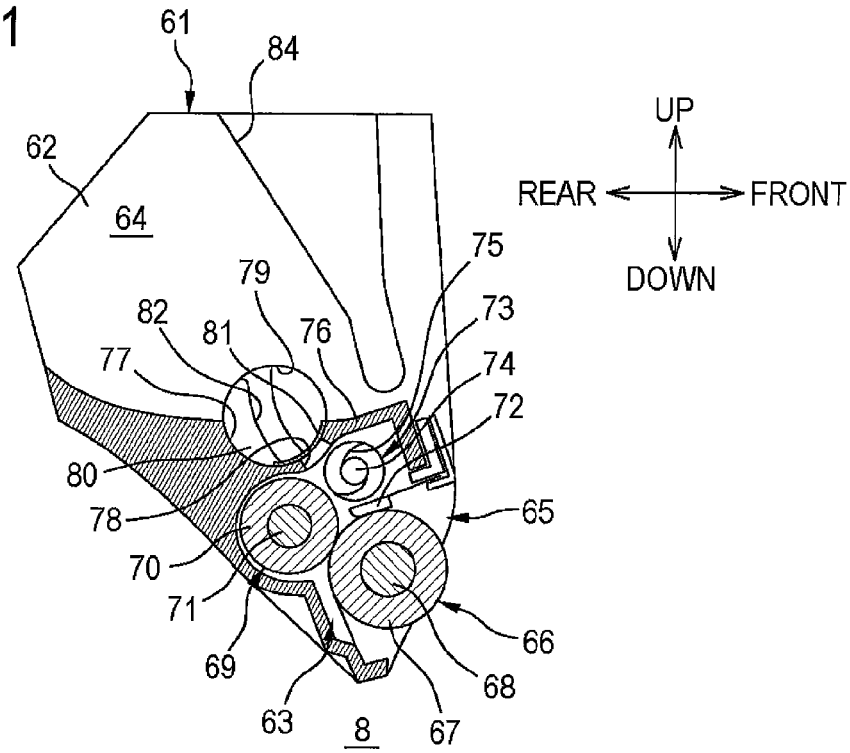
FIG. 11 is a cross-sectional view of the developing unit, in which the developing-unit-side shutter is in the closed position.
Figure 12:
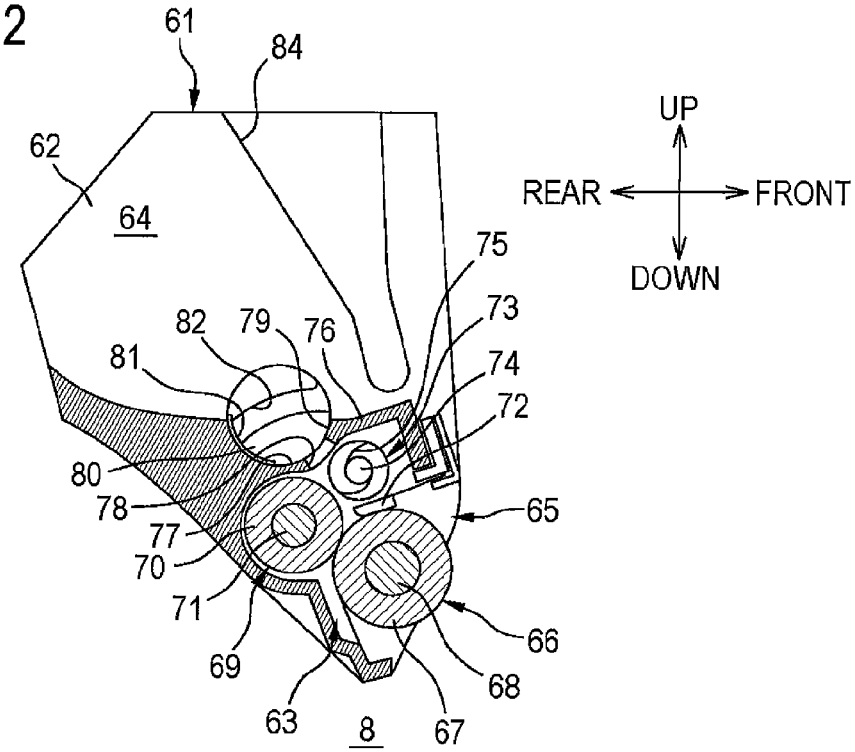
FIG. 12 is a cross-sectional view of the developing unit, in which the developing-unit-side shutter is in the open position.

As shown in FIGS. 11 and 12, an opening 65 is formed in the lower end of the case 61. The opening 65 opens toward the corresponding photosensitive drum 6.

A developing roller 66 is disposed in the bottom portion of the developing chamber 63. The developing roller 66 has a cylindrical main developing roller body 67 having a central axis that extends in the left-to-right direction, and a developing roller shaft 68 that is inserted through the main developing roller body 67 along the central axis. A portion of the peripheral surface of the main developing roller body 67 is exposed outside the case 61 through the opening 65. The developing roller shaft 68 is rotatably supported in the left and right side plates 62. The developing roller shaft 68 is inserted through the side plates 62 and protrudes on the outside of the same.

A supply roller 69 is provided in the developing chamber 63. The supply roller 69 has a cylindrical main supply roller body 70 whose central axis extends in the left-to-right direction, and a supply roller shaft 71 that is inserted through the main supply roller body 70 along the central axis. The supply roller 69 is disposed in the developing chamber 63 so that the main supply roller body 70 contacts the upper rear portion of the main developing roller body 67. The supply roller shaft 71 is rotatably supported in the left and right side plates 62 and is inserted through the side plates 62 so as to protrude outward therefrom.

A thin plate-shaped thickness-regulating blade 72 is provided in a position blocking the space between the front edge of the opening 65 and the main developing roller body 67 of the developing roller 66. One end of the thickness-regulating blade 72 is held in the case 61, while the other free end can move through flexural deformation of the thickness-regulating blade 72. The free end of the thickness-regulating blade 72 contacts the top of the main developing roller body 67.

An auger 73 is also provided in the developing chamber 63 at a position diagonally upward and forward of the supply roller 69. The auger 73 has an auger shaft 74 extending in the left-to-right direction, and an auger screw 75 forming a helical shape around the circumference of the auger shaft 74. The auger shaft 74 is rotatably supported in the left and right side plates 62.

The case 61 also has a partitioning wall 76 for separating the developing chamber 63 and mounting space 64. A semicircular arc surface 77 is formed on the partitioning wall 76 in the portion of the partitioning wall 76 confronting the auger 73 from a position diagonally above and rearward of the same. The arc surface 77 has its concave curved surface on the developing chamber 63 side. As shown in FIG. 10, through-holes 78 are formed in the left-to-right center region and both left and right end regions of the arc surface 77. The through-holes 78 are rectangular and elongated in the left-to-right direction. The through-holes 78 penetrate the arc surface 77 to provide communication between the developing chamber 63 and mounting space 64.

A circular first retaining through-hole 79 is formed in each of the side plates 62. The first retaining through-holes 79 have substantially the same curvature as the top surface of the arc surface 77, so that their peripheral edges conform to the top surface of the arc surface 77. Generally disc-shaped shutter operating members 80 are rotatably held (fitted) in corresponding first retaining through-holes 79. The shutter operating members 80 have a curvature slightly less than that of the first retaining through-holes 79. As shown in FIGS. 10 through 12, a developing-unit-side shutter 81 spans between the left and right shutter operating members 80. The developing-unit-side shutter 81 has a thin plate shape that curves to conform to the top surface of the arc surface 77.

As shown in FIGS. 6 and 7, a first engagement groove 82 is formed in the inside surface of each shutter operating members 80. Each first engagement groove 82 for the yellow, magenta, and cyan developing units 8 is a single groove passing through the center of the shutter operating member 80 and extending linearly from one edge to the other, forming openings in the edge of the shutter operating member 80 at two diametrically opposing positions. The first engagement grooves 82 for the black developing unit 8, however, are slightly curved. The convex curved side of the first engagement grooves 82 faces rearward when the through-holes 78 are closed by the developing-unit-side shutter 81 (see FIG. 13).

As shown in FIG. 10, a coupling protrusion 83 is formed on the outer surface of each shutter operating member 80. The coupling protrusions 83 are ridge-like protrusions that appear rectangular in a side view and extend along a diameter of the shutter operating member 80 (see FIGS. 8 and 9).

As shown in FIGS. 6 and 7, a toner unit guide groove 84 is formed in each of the left and right side plates 62. The toner unit guide grooves 84 for the black developing unit 8 extend diagonally upward and rearward from a position near the partitioning wall 76, then bend slightly and proceed diagonally upward and rearward along a gentler slope. The toner unit guide grooves 84 for yellow, magenta, and cyan extend upward from a position near the corresponding partitioning walls 76. Each of the toner unit guide grooves 84 gradually widens from a midway point to the upper side and is open in the top surface of the corresponding side plate 62.

2-5. Developing Unit Support Plates

Figure 8:
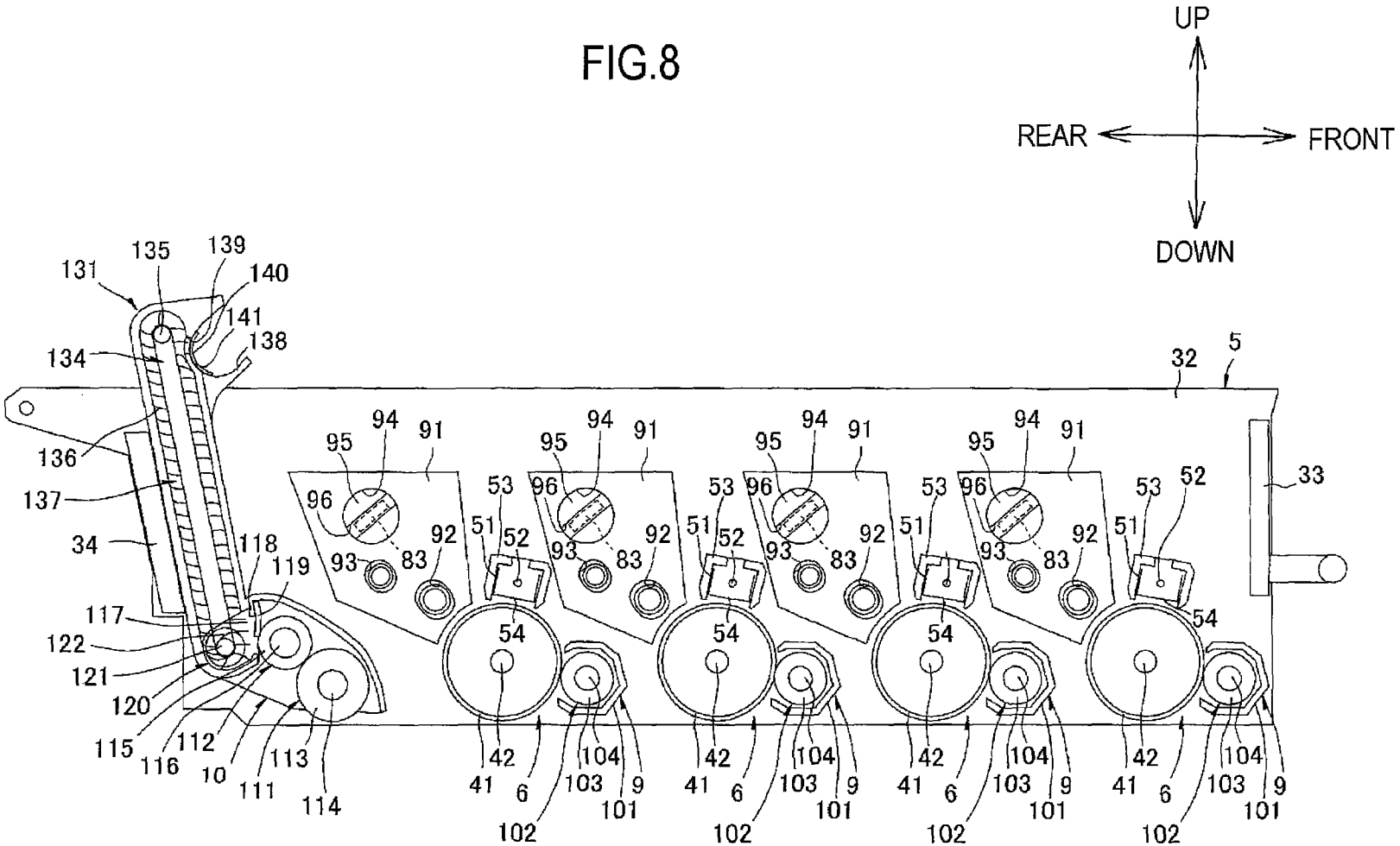
FIG. 8 is a cross-sectional view of the drawer unit, from which showing of developing units is omitted, wherein second engagement grooves are aligned in a slanted direction upward toward the front (the developing-unit-side shutters are in the closed position)
Figure 9:
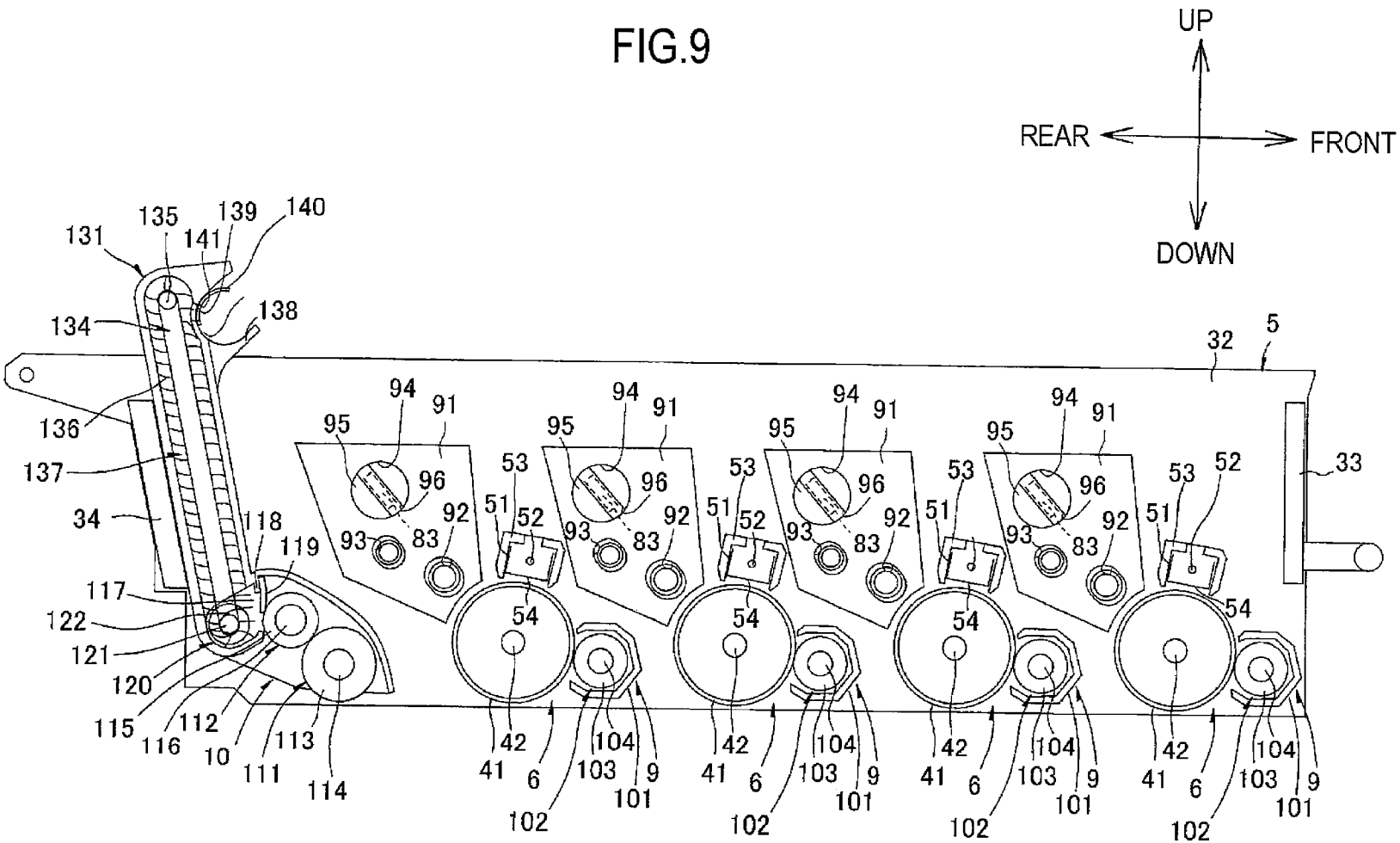
FIG. 9 is a cross-sectional view of the drawer unit, from which showing of the developing units is omitted, wherein the second engagement grooves are aligned in a slanted direction downward toward the front (the developing-unit-side shutters are in the open position)
Figure 10:
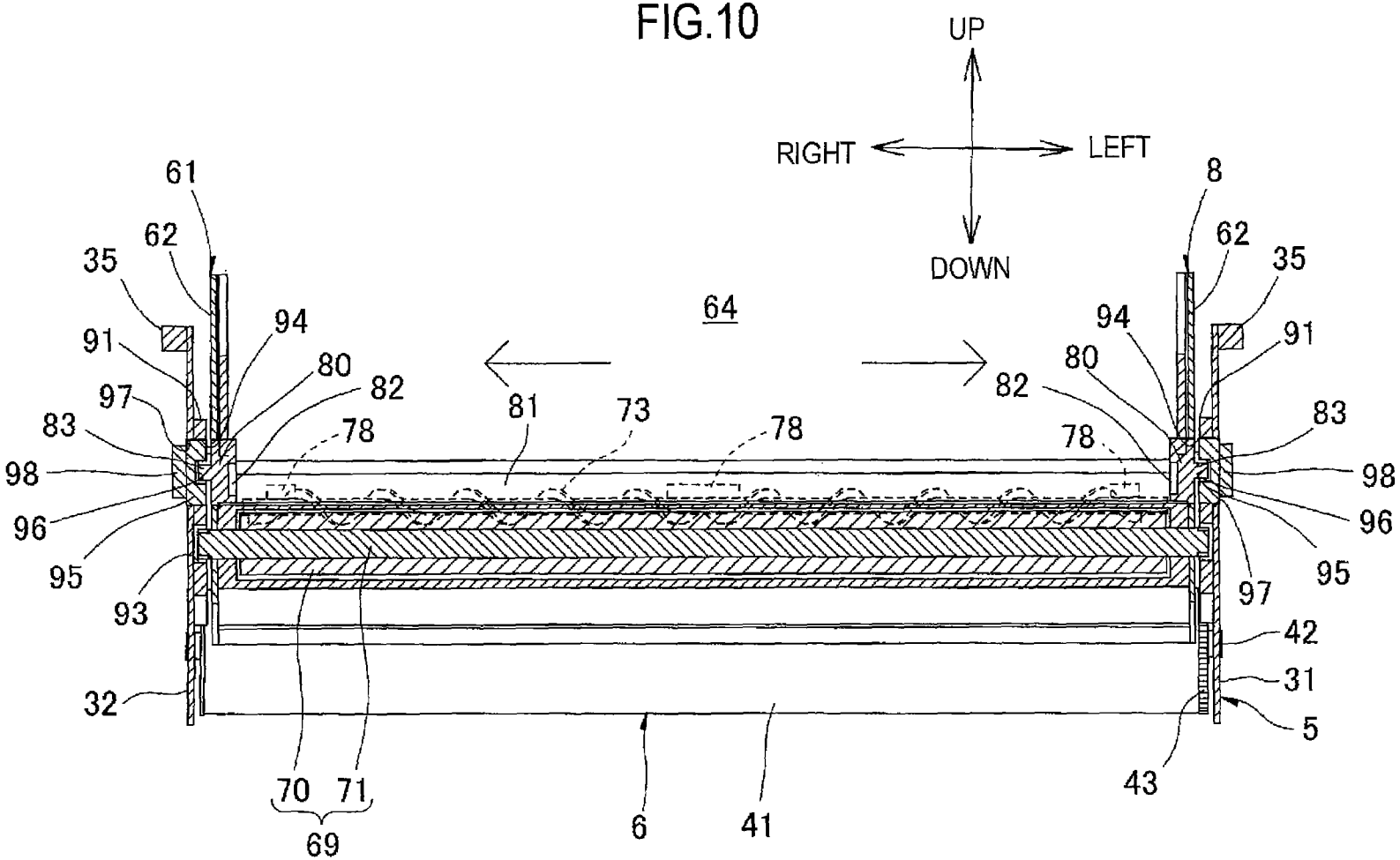
FIG. 10 is a sectional view of the drawer unit taken along a line A-A in FIG. 6 and shown from the rear side to the front side.

As shown in FIGS. 8 through 10, developing unit support plates 91 are fixed to the inner surfaces of the side plates 31 and 32 constituting the drawer frame 5.

The developing unit support plates 91 are provided at positions corresponding to the four developing units 8. Each developing unit support plate 91 has formed therein a developing roller shaft support through-hole 92 for receiving and supporting one end of the corresponding developing roller shaft 68, and a supply roller shaft support through-hole 93 for receiving and supporting one end of the corresponding supply roller shaft 71. Both the support through-holes 92 and 93 are elongated through-holes with a long axis extending obliquely upward and rearward (or downward and forward).

A circular second retaining through-hole 94 having a curvature substantially equal to that of the first retaining through-hole 79 is formed in the developing unit support plate 91 at a position opposing the shutter operating member 80 (see FIGS. 6 and 7) in the left-to-right direction. A generally disc-shaped manual operating member 95 is rotatably retained (fitted) in the second retaining through-hole 94. The manual operating member 95 has substantially the same curvature as the shutter operating member 80.

The inner surface of the manual operating member 95 is approximately flush with the inner surface of the developing unit support plate 91, as illustrated in FIG. 10. A second engagement groove 96 is formed in the inner surface of the manual operating member 95. The second engagement groove 96 is a single groove extending linearly along a diameter of the manual operating member 95 and forming openings in the circumferential edge of the manual operating member 95. The coupling protrusion 83 of the corresponding shutter operating member 80 is engaged in the second engagement groove 96.

As shown in FIGS. 4, 5, and 10, circular through-holes 97 are formed in the side plates 31 and 32 constituting the drawer frame 5 at positions overlapping the second retaining through-holes 94 in the left-to-right direction. The through-holes 97 have the same curvature as the second retaining through-holes 94. The manual operating members 95 are fitted into corresponding through-holes 97. An operating knob 98 is formed on the outer surface of each manual operating member 95. As shown in FIGS. 4 and 5, the operating knobs 98 are formed as ridges that appear rectangular in a side view and extend along a diameter of the manual operating member 95.

2-6. Drum Cleaners

As shown in FIGS. 6 and 7, each drum cleaner 9 has a case 101. The case 101 forms a general C-shape in cross section that is open on the photosensitive drum 6 side. The cases 101 span between the side plates 31 and 32 of the drawer frame 5.

A drum cleaning roller 102 is accommodated in the case 101. The drum cleaning roller 102 has a cylindrical main roller body 103 whose central axis is oriented in the left-to-right direction, and a roller shaft 104 inserted through the main roller body 103 along its central axis. The drum cleaning roller 102 is disposed so that the main roller body 103 contacts the photosensitive drum 6.

2-7. Belt Cleaner

As shown in FIGS. 6 and 7, the belt cleaner 10 includes a primary belt cleaning roller 111, and a secondary belt cleaning roller 112.

The primary belt cleaning roller 111 is disposed in the lower rear corner of the drawer frame 5. The primary belt cleaning roller 111 has a cylindrical main roller body 113 whose central axis is oriented in the left-to-right direction, and a roller shaft 114 inserted through the main roller body 113 along its central axis. The roller shaft 114 is rotatably supported in the side plates 31 and 32 of the drawer frame 5.

As shown in FIGS. 6 and 7, the secondary belt cleaning roller 112 has a cylindrical main roller body 115 whose central axis is oriented in the left-to-right direction, and a roller shaft 116 inserted through the main roller body 115 along its central axis. The main roller body 115 contacts the main roller body 113 of the primary belt cleaning roller 111 along substantially its entire width from a position above and rearward thereof. The roller shaft 116 is rotatably supported in the side plates 31 and 32 of the drawer frame 5.

A waste toner conveying chamber 117 is provided to the rear of the secondary belt cleaning roller 112. The waste toner conveying chamber 117 is formed by a chamber wall 118. The chamber wall 118 extends in the left-to-right direction and is generally U-shaped in cross section, opening diagonally upward and forward. The left and right ends of the chamber wall 118 are connected to the left and right side plates 31 and 32, respectively. The left and right side plates 31 and 32 close the left and right sides of the waste toner conveying chamber 117.

A scraper 119 is mounted in the upper front edge of the chamber wall 118. The scraper 119 is plate-shaped and extends downward from the upper front edge of the chamber wall 118. The lower edge portion of the scraper 119 contacts the circumferential surface of the secondary belt cleaning roller 112 (the main roller body 115) along its upper rear side.

Figure 13:
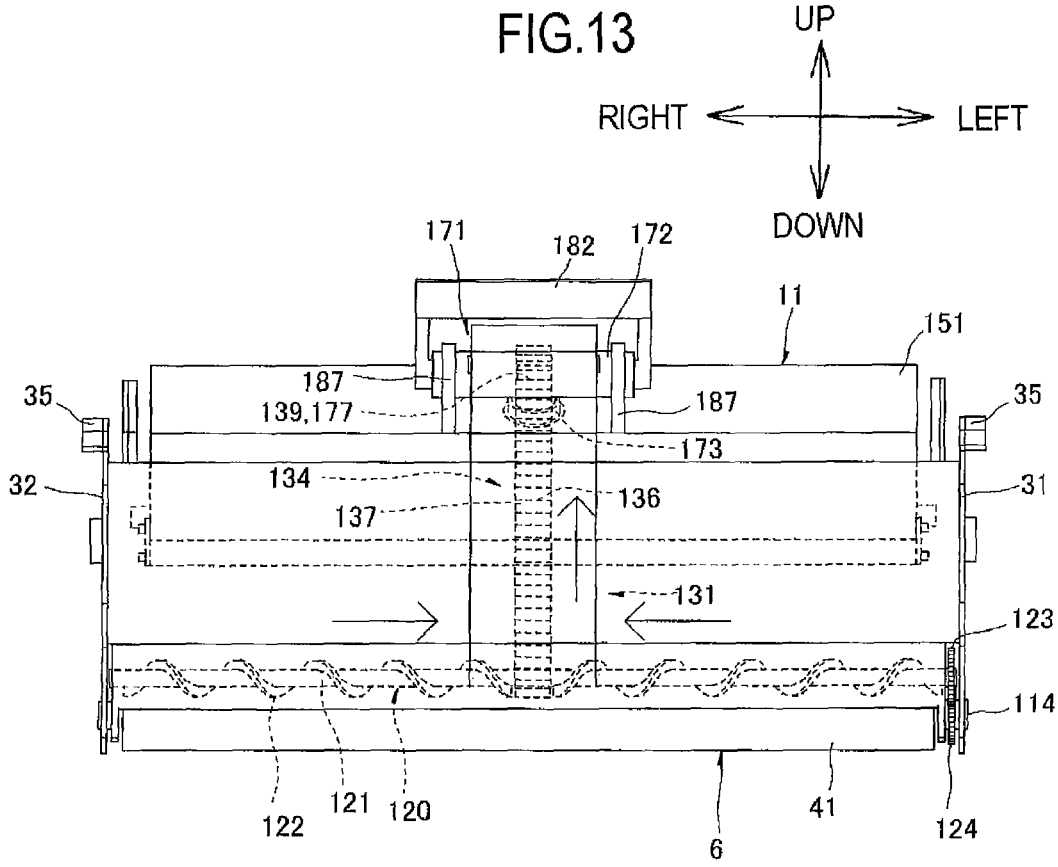
FIG. 13 is a rear view of the drawer unit.
Figure 14:
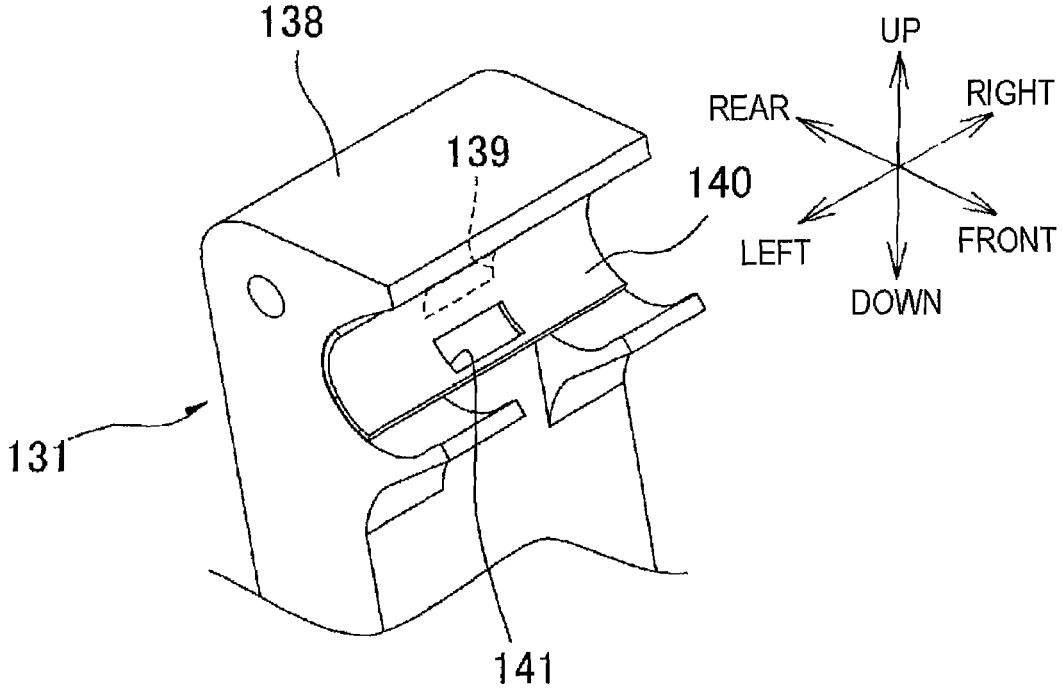
FIG. 14 is a perspective view of a coupling part in the rear conveying unit.

An auger 120 is disposed inside the waste toner conveying chamber 117. The auger 120 is configured of an auger shaft 121 extending in the left-to-right direction, and an auger screw 122 formed in a helical shape around the circumference of the auger shaft 121. The auger shaft 121 is rotatably supported in the left and right side plates 31 and 32. As shown in FIG. 13, the portion of the auger screw 122 on the left half of the auger shaft 121 is wound in the direction opposite that on the right half. An auger gear 123 is attached to the left end of the auger shaft 121. The auger gear 123 couples a first belt cleaning gear 124 to a second belt cleaning gear (not shown).

When the drawer unit 3 is in the accommodated position inside the main casing 2, the main roller body 113 contacts the intermediate transfer belt 13 along substantially the entire width thereof, as shown in FIG. 1. A backup roller 125 is disposed confronting the primary cleaning roller 111 through the intermediate transfer belt 13.

2-8. Rear Conveying Unit

As shown in FIGS. 4 through 9, a rear conveying unit 131 is fixed to the front side surface of the ream beam 34 at its left-to-right center region. The rear conveying unit 131 has an elongated shape extending obliquely upward and rearward from the left-to-right center region in the chamber wall 118 of the belt cleaner 10. As shown in FIGS. 6-9, the rear conveying unit 131 has a hollow shape, and the space inside the rear conveying unit 131 serves as a waste toner conveying chamber 134.

A belt shaft 135 is rotatably supported in the top end of the waste toner conveying chamber 134. As shown in FIG. 13, a toner conveying belt 137 is looped around the left-to-right center portion of the auger shaft 121 and the belt shaft 135 (see FIG. 6). The toner conveying belt 137 has multiple protrusions 136 formed along its outer peripheral surface. The protrusions 136 are spaced at equal intervals in the circumferential direction of the toner conveying belt 137.

A coupling part 138 is integrally formed with the top end of the rear conveying unit 131 for receiving an upper conveying member 171 (described later) provided with the black toner unit 11 when the black toner unit 11 is mounted. The coupling part 138 is generally C-shaped in a side view, opening diagonally upward and forward. As shown in FIGS. 4-9 and 14, a through-hole 139 is formed in the coupling part 138 and provides communication with the outside of the waste toner conveying chamber 134 (the space surrounded by the C-shape of the coupling part 138) and the interior of the waste toner conveying chamber 134.

An outer shutter 140 is disposed in the space surrounded by the C-shape of the coupling part 138. The outer shutter 140 has a thin plate shape that curves to conform to the front surface of the coupling part 138. The outer shutter 140 is provided so as to be movable along the front surface of the coupling part 138. The outer shutter 140 is formed with an opening 141 at the same left-to-right position as the through-hole 139. The opening 141 has a rectangular shape identical to the through-hole 139 and a size also identical to the through-hole 139.

3. Toner Unit 3-1. Black Toner Unit

As shown in FIGS. 15 through 18, the black toner unit 11 has a case 151. The case 151 has a larger front-to-rear dimension than a case 201 of the yellow, magenta, and cyan toner units 11 described later.

Figure 17:
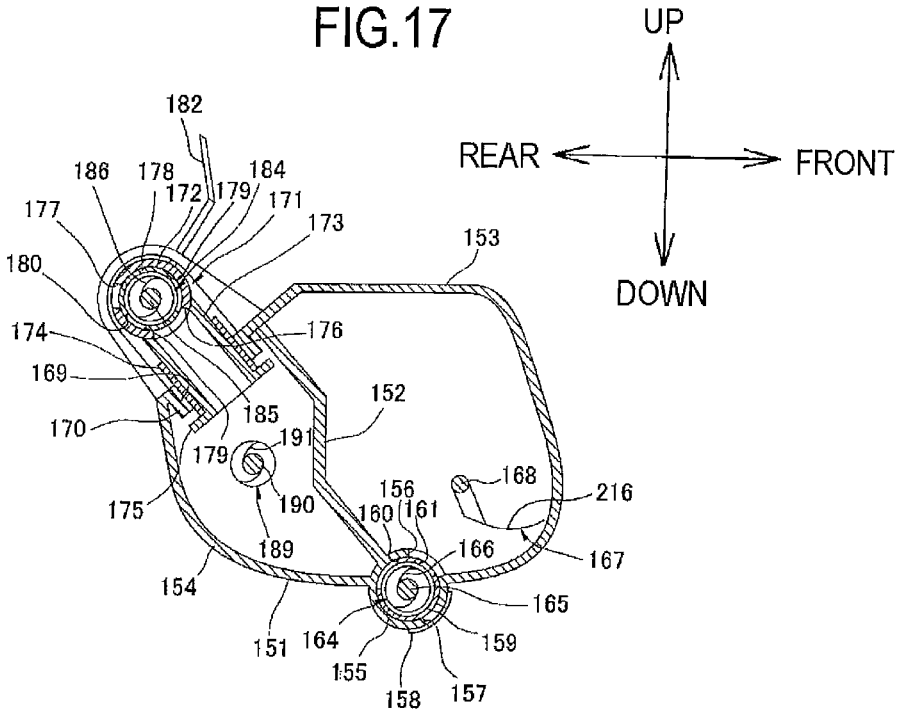
FIG. 17 is a cross-sectional view of the black toner unit, in which the operating lever extends upward, an inner cylindrical body is in a closed position, and a cylindrical shutter is in a closed position.
Figure 18:
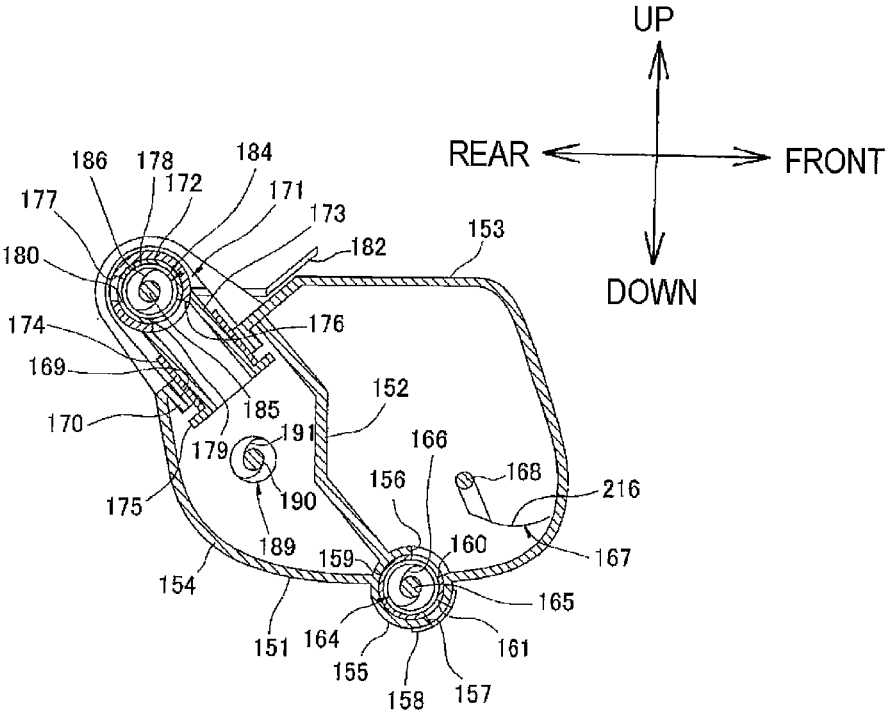
FIG. 18 is a cross-sectional view of the black toner unit, in which the operating lever extends forward, the inner cylindrical body is in an open position, and the cylindrical shutter is in an open position.

As shown in FIGS. 17 and 18, a partitioning wall 152 is formed in the case 151. The partitioning wall 152 divides the interior space of the case 151 into a rear space and a front space. The space formed on the front side of the partitioning wall 152 serves to accommodate toner that is supplied to the developing unit 8. The portion of the case 151 defining the space on the front side of the partitioning wall 152 will be referred to as a toner accommodating part 153. The space on the rear side of the partitioning wall 152 serves to accommodate disposed toner (waste toner). The portion of the case 151 defining the space on the rear side of the partitioning wall 152 will be referred to as a waste toner accommodating part 154.

Hence, the case 151 is integrally provided with the toner accommodating part 153 and waste toner accommodating part 154.

An outer cylindrical body 155 having a circular cross section is integrally formed on the bottom edge of the case 151. A first outer-body-side supply through-hole 156 is formed in a portion of the outer cylindrical body 155 confronting the toner accommodating part 153. Second outer-body-side supply through-holes 157 are formed in the left to right center and both left and right ends of the outer cylindrical body 155 in regions facing externally. A sealing material 158 is provided on the outer peripheral surface of the outer cylindrical body 155 surrounding the circumference of the second outer-body-side supply through-holes 157.

An inner cylindrical body 159 having a circular cross section is rotatably provided on the inside of the outer cylindrical body 155 in a state in contact with the inner peripheral surface of the outer cylindrical body 155. A first inner-body-side supply through-hole 160 is formed in the inner cylindrical body 159 at a position opposing the first outer-body-side supply through-hole 156. Second inner-body-side supply through-holes 161 are formed in the inner cylindrical body 159 at positions opposing the second outer-body-side supply through-holes 157. The first inner-body-side supply through-hole 160 is identical in shape to the first outer-body-side supply through-hole 156. The second inner-body-side supply through-holes 161 are identical in shape to the second outer-body-side supply through-holes 157.

Figure 15:
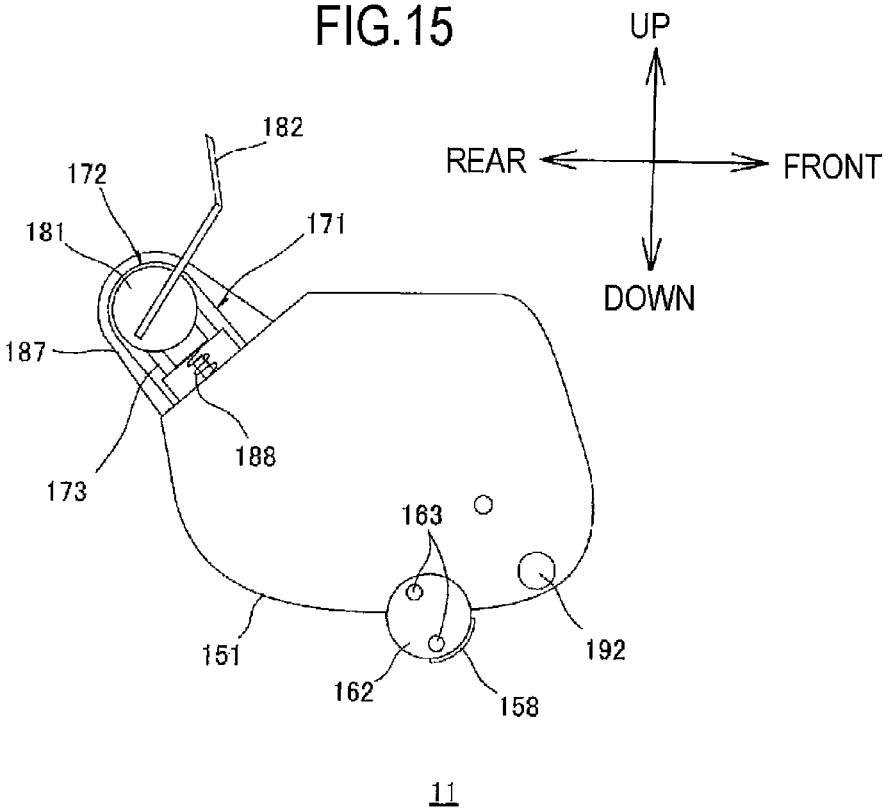
FIG. 15 is a left-side view of a black toner unit, in which an operating lever extends upward.
Figure 16:
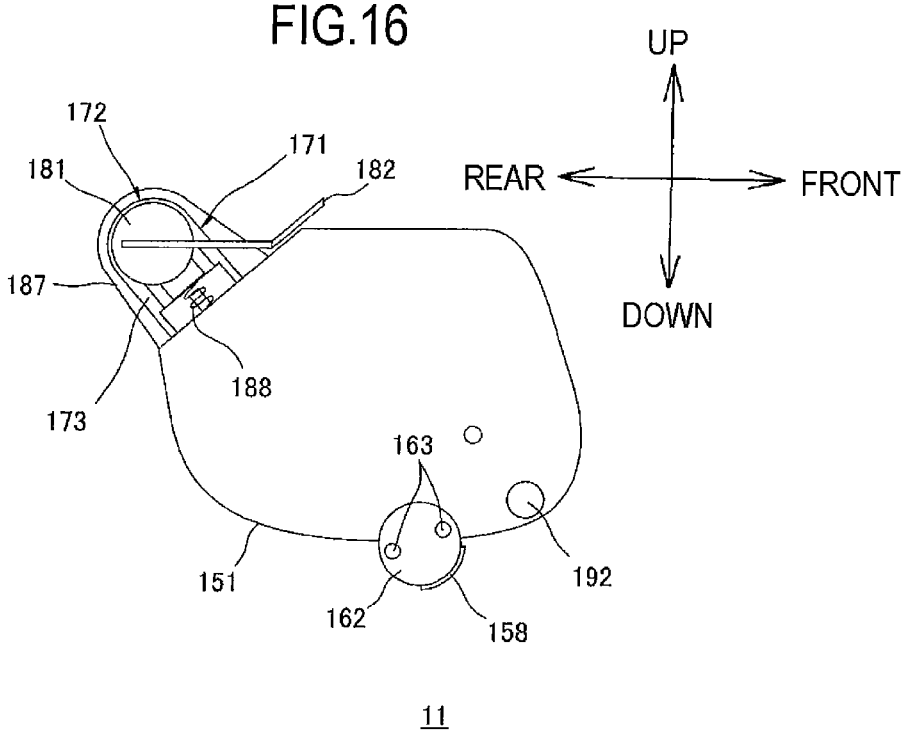
FIG. 16 is a left-side view of the black toner unit, in which the operating lever extends forward.

As shown in FIGS. 15 and 16, a disc-shaped left enclosing plate 162 is provided on the left end of the outer cylindrical body 155 and inner cylindrical body 159. The left enclosing plate 162 closes off the left ends of both the outer cylindrical body 155 and inner cylindrical body 159. The left end of the inner cylindrical body 159 is fixed to the left enclosing plate 162. Two engaging bosses 163 are formed on the outer surface (left endface) of the left enclosing plate 162. The engaging bosses 163 are columnar-shaped and are disposed in diametrically opposed positions.

Figure 19:
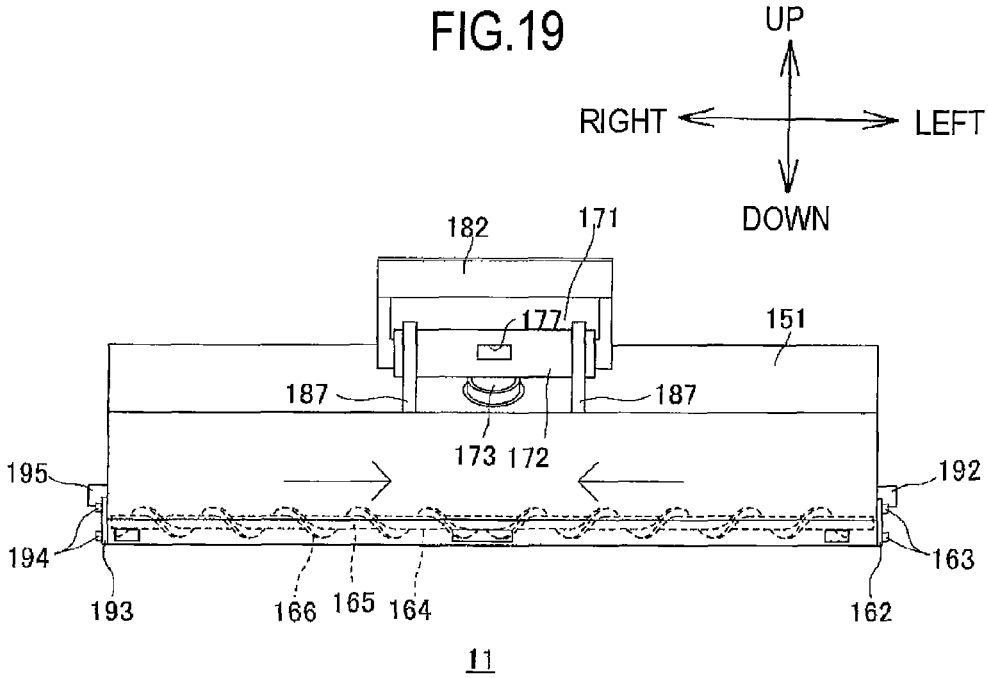
FIG. 19 is a rear view of the black toner unit.

As shown in FIG. 19, a disc-shaped right enclosing plate 193 is provided on the right end of the outer cylindrical body 155 and inner cylindrical body 159. The right enclosing plate 193 closes off the right ends of both the outer cylindrical body 155 and inner cylindrical body 159. The right end of the inner cylindrical body 159 is fixed to the right enclosing plate 193. Through this structure, the inner cylindrical body 159, left enclosing plate 162, and right enclosing plate 193 are capable of rotating as a unit. Two engaging bosses 194 are formed on the outer surface (right endface) of the right enclosing plate 193. The engaging bosses 194 are columnar-shaped and disposed in two diametrically opposing positions.

As shown in FIGS. 17 and 18, an auger 164 is provided inside the inner cylindrical body 159. The auger 164 is configured of an auger shaft 165 oriented in the left-to-right direction, and an auger screw 166 formed in a helical shape around the circumference of the auger shaft 165. The left and right ends of the auger 164 are rotatably supported in the left enclosing plate 162 and right enclosing plate 193, respectively. As shown in FIG. 19, the portion of the auger screw 166 on the left half of the auger shaft 165 is wound in the direction opposite that on the right half.

As shown in FIGS. 17 and 18, an agitator 167 is provided inside the toner accommodating part 153. The agitator 167 is configured of an agitator shaft 168 extending in the left-to-right direction and an agitating film 216 held by the agitator shaft 168. The agitator shaft 168 is rotatably supported in the left and right side surfaces of the toner accommodating part 153 (the case 151).

As shown in FIGS. 17 and 18, a circular through-hole 169 is formed in the left-to-right center of the waste toner accommodating part 154 (the case 151) near the top edge of the partitioning wall 152. A piston guide part 170 is formed in the waste toner accommodating part 154. The piston guide part 170 has a flattened cylindrical shape and protrudes obliquely downward and forward from the peripheral edge of the circular through-hole 169.

An upper conveying member 171 is provided on the upper rear side of the case 151. The upper conveying member 171 includes a main body part 172 elongated in the left-to-right direction, and a connecting part 173 extending obliquely downward and forward from the left-to-right center portion of the main body part 172.

As shown in FIGS. 17, 18, and 19, the main body part 172 has a cylindrical shape.

The connecting part 173 is cylindrical in shape with its central axis extending obliquely downward and forward. The outer diameter of the connecting part 173 is slightly smaller than the inner diameter of the piston guide part 170. The connecting part 173 is inserted into the piston guide part 170. A cylindrical sealing member 174 is affixed to the outer peripheral surface of the connecting part 173 for sealing the gap between the inner peripheral surface of the piston guide part 170 and the outer peripheral surface of the connecting part 173. A flange 175 is formed on the lower front end portion (distal end portion) of the connecting part 173, jutting radially outward from this end portion.

As shown in FIGS. 17 and 18, an internal communication through-hole 176 is formed in a portion of the main body part 172 confronting the interior of the connecting part 173. As shown in FIG. 19, a rectangular-shaped external communication through-hole 177 is formed in the left-to-right center portion of the main body part 172. The external communication through-hole 177 faces rearward.

As shown in FIGS. 17 and 18, a cylindrical shutter 178 having a circular cross section is rotatably provided inside the main body part 172. The shutter 178 can rotate while contacting the inner peripheral surface of the main body part 172. An opening 179 identical in shape to the internal communication through-hole 176 formed in the main body part 172 is formed in the shutter 178 at the same left-to-right position as the internal communication through-hole 176. An opening 180 identical in shape to the external communication through-hole 177 formed in the main body part 172 is also formed in the shutter 178 at the same left-to-right position as the external communication through-hole 177.

As shown in FIGS. 15 and 16, a disc-shaped left enclosing plate 181 is provided on the left end of the main body part 172 and shutter 178. The left enclosing plate 181 closes off the left ends of both the main body part 172 and shutter 178. The left end of the shutter 178 is fixed to the left enclosing plate 181.

While not shown in the drawings, a right enclosing plate is provided on the right ends of the main body part 172 and shutter 178. The right enclosing plate closes off the right ends of both the main body part 172 and shutter 178. The right end of the shutter 178 is fixed to the right enclosing plate. Through this structure, the shutter 178, left enclosing plate 181, and right enclosing plate are capable of rotating as a unit.

As shown in FIG. 19, an operating lever 182 is provided to span between the left enclosing plate 181 and the right enclosing plate. The operating lever 182 has an angular C-shape in a rear view. When the operating lever 182 is operated, the shutter 178 can be rotated between an open position in which the openings 179 and 180 are in communication with the internal communication through-hole 176 and external communication through-hole 177 of the main body part 172, and a closed position in which the openings 179 and 180 are closed by the peripheral surface of the shutter 178.

As shown in FIGS. 17 and 18, an auger 184 is provided inside the shutter 178. The auger 184 is configured of an auger shaft 185 oriented in the left-to-right direction, and an auger screw 186 formed in a helical shape around the circumference of the auger shaft 185. The auger 184 is rotatably supported in the left enclosing plate 181 and the right enclosing plate.

As shown in FIGS. 15, 16, and 19, toner-unit-side receiving parts 187 are formed on both of a pair of opposite outer sides of the piston guide portion 170 that is disposed on the left-to-right center region of the case 151. The toner-unit-side receiving parts 187 are U-shaped in a side view and, together with the case 151 (the waste toner accommodating part 154), surrounds the main body part 172. A spring 188 is interposed between the case 151 and main body part 172 within the region surrounded by each toner-unit-side receiving part 187 for urging the main body part 172 away from the case 151 (in a direction obliquely upward and rearward).

As shown in FIGS. 17 and 18, an auger 189 is provided inside the waste toner accommodating part 154. The auger 189 is configured of an auger shaft 190 that extends in the left-to-right direction, and an auger screw 191 formed in a helical shape around the circumference of the auger shaft 190. The auger shaft 190 is rotatably supported in the left and right sides of the waste toner accommodating part 154 (the case 151). The portion of the auger screw 191 on the left half of the auger shaft 190 is wound in the direction opposite that on the right half.

As shown in FIGS. 15 and 16, a columnar-shaped guided boss 192 is provided on the left side surface of the case 151. Specifically, the guided boss 192 protrudes leftward from a region near the bottom front corner of the case 151. Similarly, as shown in FIG. 19, a guided boss 195 is provided on the right surface of the case 151 and protrudes rightward therefrom. The guided boss 195 is also columnar-shaped with the same diameter as the guided boss 192 and is disposed in a position aligned with the guided boss 192 on the left side with respect to the left-to-right direction.

3-2. Toner Unit for Each of Yellow, Magenta, and Cyan

Figure 20:
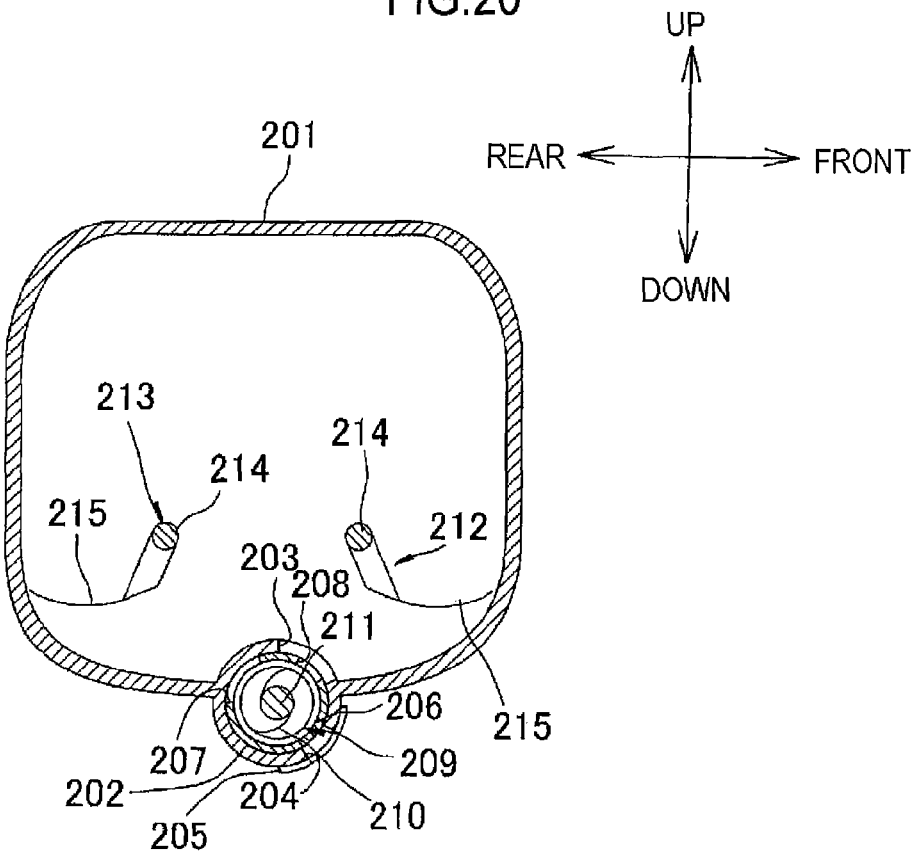
FIG. 20 is a cross-sectional view of a toner unit for yellow, magenta, or cyan, in which an inner cylindrical body is in a closed position.
Figure 21:
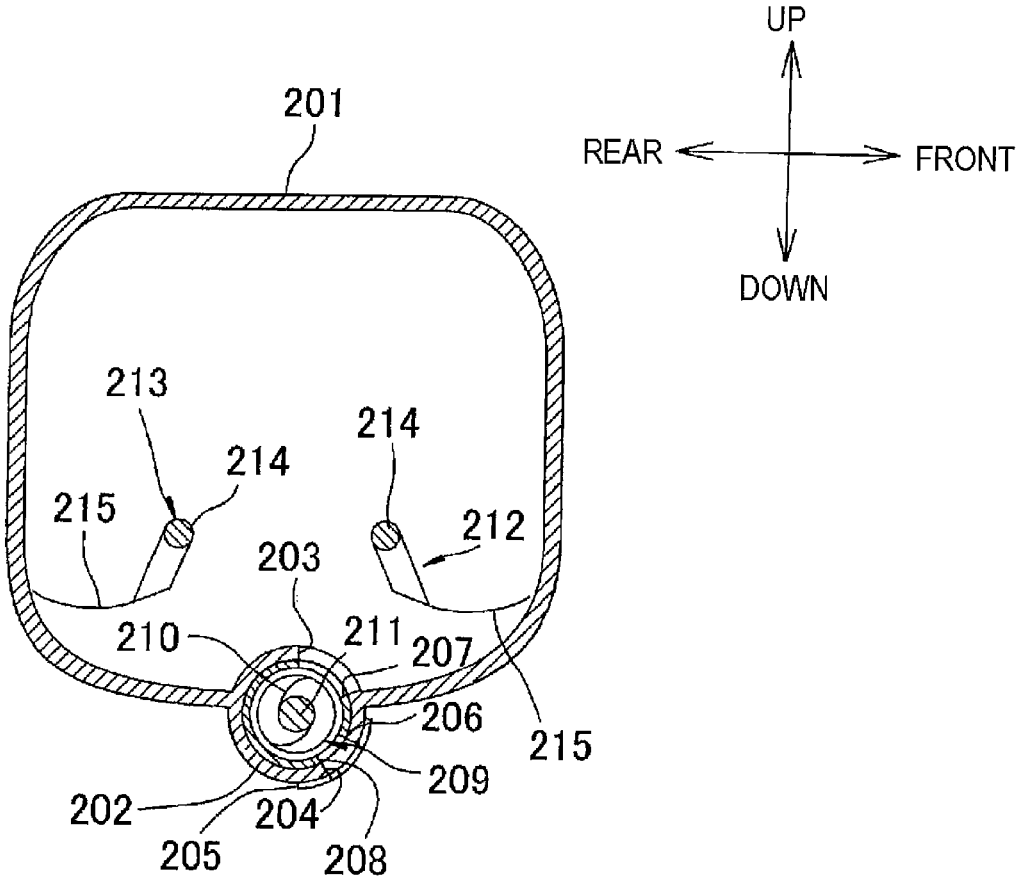
FIG. 21 is a cross-sectional view of the toner unit for yellow, magenta, or cyan, in which the inner cylindrical body is in an open position.

As shown in FIGS. 20 and 21, the toner unit 11 for each of yellow, cyan, and magenta has a case 201. Toner is accommodated in the case 201.

An outer cylindrical body 202 having a circular cross section is integrally formed on the bottom edge of the case 201. A first outer-body-side supply through-hole 203 is formed in a portion of the outer cylindrical body 202 confronting the inside of the case 201. Second outer-body-side supply through-holes 204 are formed in the left to right center and both left and right ends of the outer cylindrical body 202 in regions facing externally. A sealing material 205 is provided on the outer peripheral surface of the outer cylindrical body 202 surrounding the circumference of the second outer-body-side supply through-holes 204.

An inner cylindrical body 206 having a circular cross section is rotatably provided on the inside of the outer cylindrical body 202 in a state in contact with the inner peripheral surface of the outer cylindrical body 202. A first inner-body-side supply through-hole 207 is formed in the inner cylindrical body 206 at a position opposing the first outer-body-side supply through-hole 203. Second inner-body-side supply through-holes 208 are formed in the inner cylindrical body 206 at positions opposing the second outer-body-side supply through-holes 204. The first inner-body-side supply through-hole 207 is identical in shape to the first outer-body-side supply through-hole 203. The second inner-body-side supply through-holes 208 are identical in shape to the second outer-body-side supply through-holes 204.

Although not shown in the drawings, a disc-shaped left enclosing plate is provided on the left end of the outer cylindrical body 202 and inner cylindrical body 206. The left enclosing plate closes off the left ends of both the outer cylindrical body 202 and inner cylindrical body 206. The left end of the inner cylindrical body 206 is fixed to the left enclosing plate. Two engaging bosses are formed on the outer surface (left endface) of the left enclosing plate. The engaging bosses are columnar-shaped and are disposed in diametrically opposed positions. A disc-shaped right enclosing plate is provided on the right end of the outer cylindrical body 202 and inner cylindrical body 206. The right enclosing plate closes off the right ends of both the outer cylindrical body 202 and inner cylindrical body 206. The right end of the inner cylindrical body 206 is fixed to the right enclosing plate. Through this structure, the inner cylindrical body 206, left enclosing plate, and right enclosing plate are capable of rotating as a unit. Two engaging bosses are formed on the outer surface (right endface) of the right enclosing plate. The engaging bosses are columnar-shaped and disposed in two diametrically opposing positions.

An auger 209 is provided inside the inner cylindrical body 206. The auger 209 is configured of an auger shaft 211 oriented in the left-to-right direction, and an auger screw 210 formed in a helical shape around the circumference of the auger shaft 211. The left and right ends of the auger 209 are rotatably supported in the left enclosing plate and right enclosing plate, respectively.

Two agitators 212 and 213 are provided inside the case 201. The agitators 212 and 213 are juxtaposed in the front-to-rear direction. The agitators 212 and 213 have the same configuration with each other. That is, each of the agitators 212 and 213 is configured of an agitator shaft 214 extending in the left-to-right direction and an agitating film 215 held by the agitator shaft 214. The agitator shaft 214 is rotatably supported in the left and right side surfaces of the case 201.

Although not shown in the drawings, a columnar-shaped guided boss is provided on the left side surface of the case 201 to protrude leftward (outward) from a region near the bottom front corner of the case 201. Similarly, a columnar-shaped guided boss is provided on the right side surface of the case 201 to protrude rightward (outward) from a region near the bottom rear corner of the case 201.

4. Mounting and Removing Toner Units

The toner units 11 are mounted into and removed from the drawer unit 3 when the front cover 4 has been opened and the drawer unit 3 has been pulled out of the main casing 2 to the pulled-out position, as shown in FIG. 3. The toner units 11 are mounted in and removed from the drawer unit 3 through the top of the corresponding mounting spaces 64 provided between the left and right side plates 62 of each developing unit 8.

When the toner units 11 have been removed from the drawer unit 3, the operating knobs 98 of all manual operating members 95 are aligned in the vertical direction, as shown in FIG. 4. Further, the second engagement grooves 96 of the manual operating members 95 and the coupling protrusions 83 of the shutter operating members 80 engaged in the respective second engagement grooves 96 are aligned in a slanted direction upward toward the front (or downward toward the rear), as shown in FIG. 8. The first engagement grooves 82 of the shutter operating members 80 are aligned vertically, as shown in FIG. 6.

As shown in FIG. 17, the operating lever 182 of the black toner unit 11 extends upward. In this state, the shutter 178 is in the closed position. That is, the shutter 178 opposes and closes the external communication through-hole 177 (see FIG. 19).

In order to mount a toner unit 11 in the corresponding mounting space 64, the user positions the toner unit 11 above the mounting space 64.

In the case of the black toner unit 11, as shown in FIG. 3, the user moves the toner unit 11 downward into the mounting space 64 so that the guided boss 192 and guided boss 195 (see FIGS. 15 and 19) are introduced into the toner unit guide grooves 84 (see FIG. 6). As indicated by broken lines in FIG. 3, the user continues to move the toner unit 11 downward as the guided boss 192 and guided boss 195 are guided in the toner unit guide grooves 84. As the toner unit 11 continues its downward movement, the engaging bosses 163 and 194 (see FIG. 19) are introduced into the corresponding first engagement grooves 82 (see FIG. 6). Since the first engagement grooves 82 for the black developing unit 8 are slightly curved with their convex sides facing rearward (see FIG. 6), the toner unit 11 rotates slightly counterclockwise in a left side view while moving downward. As a result of this rotation, the main body part 172 of the upper conveying member 171 is received by the coupling part 138 (see FIG. 22). When the guided bosses 192 and 195 (see FIGS. 15 and 19) arrive at the bottommost ends of the corresponding toner unit guide grooves 84, the toner unit 11 is restricted from moving farther downward.

Figure 22:
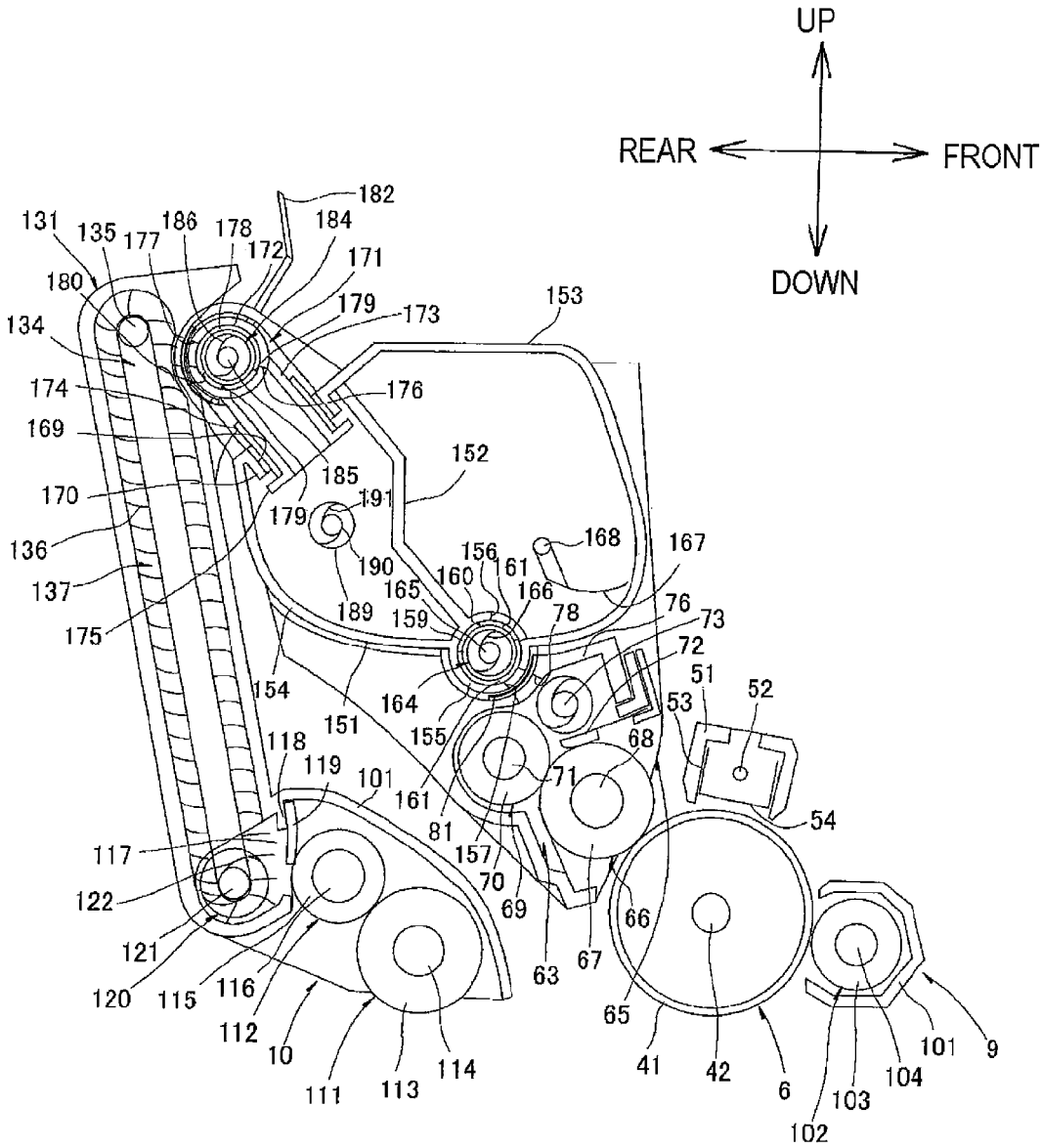
FIG. 22 is a cross-sectional view of the developing unit and the black toner unit, in which respective parts are in a closed position.

At this time, the developing-unit-side shutter 81 opposes and closes the through-holes 78, as shown in FIGS. 11 and 22, and the inner cylindrical body 159 of the toner unit 11 is in the closed position. That is, the inner cylindrical body 159 opposes and closes the second outer-body-side supply through-holes 157 as shown in FIG. 17. Further, the external communication through-hole 177 formed in the upper conveying member 171 (see FIG. 19) confronts the through-hole 139 of the rear conveying unit 131 (see FIG. 6). The through-hole 139 is closed by the outer shutter 140.

Figure 23:
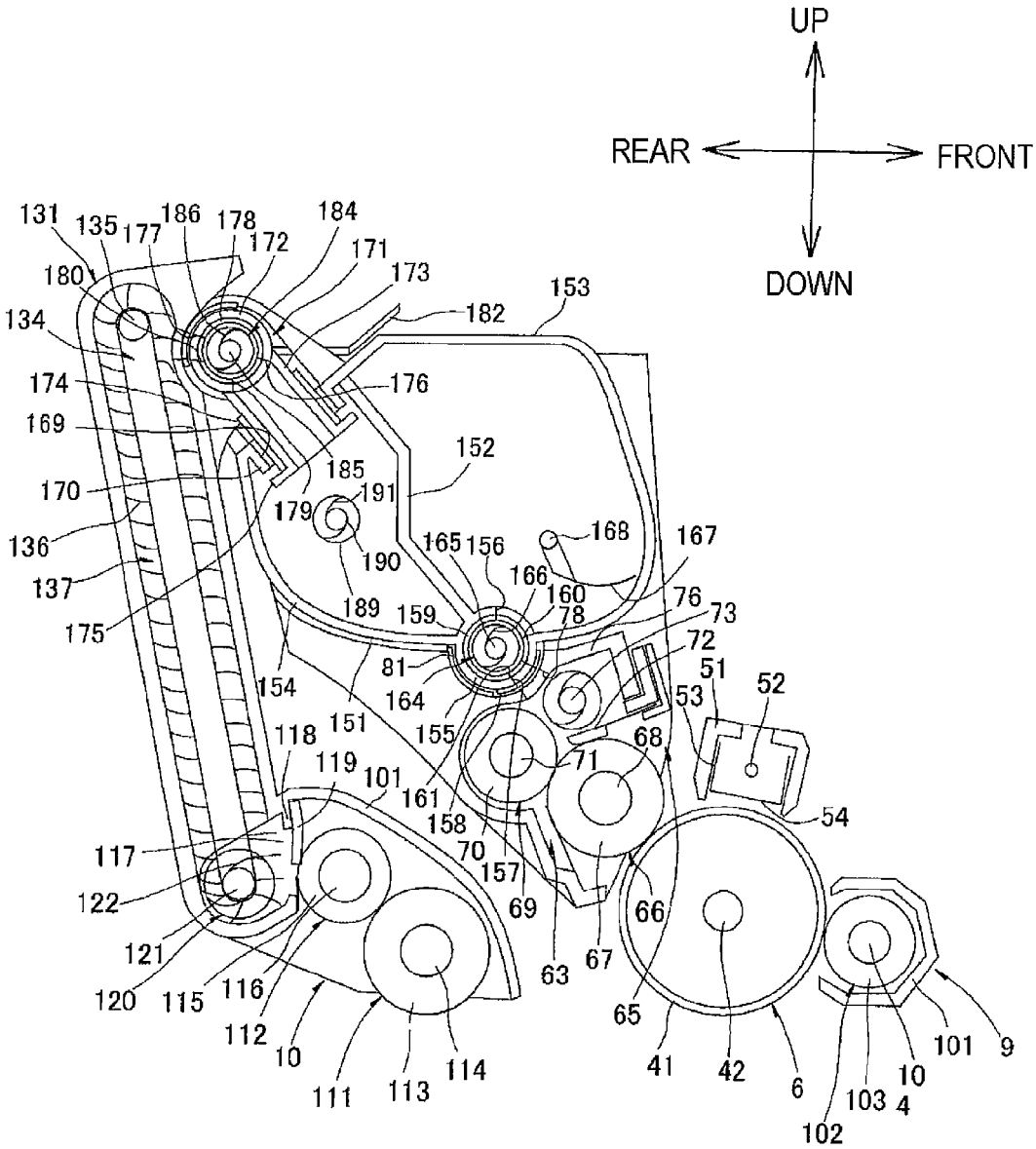
FIG. 23 is a cross-sectional view of the developing unit and the black toner unit, in which the respective parts are in an open position.

From this state, the user grips the operating knob 98 and rotates the manual operating member 95 approximately 90 degrees clockwise in a left side view until the operating knob 98 is aligned in the front-to-rear direction, as shown in FIG. 5. As the manual operating member 95 rotates, the shutter operating member 80 also rotates about 90 degrees clockwise in a left side view, moving the developing-unit-side shutter 81 to a position not confronting the through-holes 78, as shown in FIG. 12. Since the engaging bosses 163 and 194 (see FIGS. 15, 16, 19), which rotate together with the left and right enclosing plates 162 and 193, are engaged in the first engagement grooves 82 of the shutter operating member 80, the left and right enclosing plates 162 and 193 rotate about 90 degrees clockwise in a left side view, and the inner cylindrical body 159 rotates about 90 degrees clockwise together with the left and right enclosing plates 162 and 193. Through this operation, the inner cylindrical body 159 is moved to the open position so that the first inner-body-side supply through-hole 160 and second inner-body-side supply through-holes 161 formed in the inner cylindrical body 159 respectively oppose the first outer-body-side supply through-hole 156 and second outer-body-side supply through-holes 157, as shown in FIGS. 18 and 23. As a result, the developing chamber 63 of the developing unit 8 is in communication with the interior of the toner accommodating part 153 in the toner unit 11 via the through-holes 78, second outer-body-side supply through-holes 157, second inner-body-side supply through-holes 161, internal space of the inner cylindrical body 159, first inner-body-side supply through-hole 160, and first outer-body-side supply through-hole 156.

In addition, the operator rotates the operating lever 182 about 90 degrees clockwise in a left side view until the operating lever 182 extends forward, as shown in FIG. 23. This operation rotates the shutter 178 from its closed position to the open position. Hence, the openings 179 and 180 that are formed in the shutter 178 are now in communication with the internal communication through-hole 176 and external communication through-hole 177 of the main body part 172, respectively. Further, the outer shutter 140 rotates together with the rotation of the shutter 178, and the shutter opening 141 (see FIG. 14) is moved to a position confronting the through-hole 139 of the rear conveying unit 131. It is noted that the main body part 172, the outer shutter 140 and the shutter 178 have a well-known coupling configuration that enables the outer shutter 140 and the shutter 178 to rotate together. For example, the main body part 172 is formed with a slit, and the shutter 178 is formed with a protrusion. The protrusion protrudes outside the main body part 172 through the slit. When the main body part 172 is received by the coupling part 138, the protrusion is engaged with the outer shutter 140, as a result of which the outer shutter 140 becomes rotatable together with the shutter 178. As a result, the waste toner conveying chamber 134 in the rear conveying unit 131 is in communication with the interior of the shutter 178 via the through-hole 139 formed in the rear conveying unit 131, the external communication through-hole 177 formed in the main body part 172, and the opening 180 in the shutter 178. The interior of the shutter 178 is also in communication with the interior of the connecting part 173 via the opening 179 formed in the shutter 178 and the internal communication through-hole 176.

This completes the operation for mounting the black toner unit 11 in the corresponding mounting space 64.

In the case of the toner unit 11 for each of yellow, magenta, and cyan, the user moves the toner unit 11 downward into the mounting space 64 so that the guided bosses (not shown) are introduced into the toner unit guide grooves 84 (see FIG. 6). The user continues to move the toner unit 11 downward as the guided bosses are guided in the toner unit guide grooves 84. As the toner unit 11 continues its downward movement, the engaging bosses (not shown) are introduced into the corresponding first engagement grooves 82 (see FIG. 6). When the guided bosses arrive at the bottommost ends of the corresponding toner unit guide grooves 84, the toner unit 11 is restricted from moving farther downward.

Figure 24:
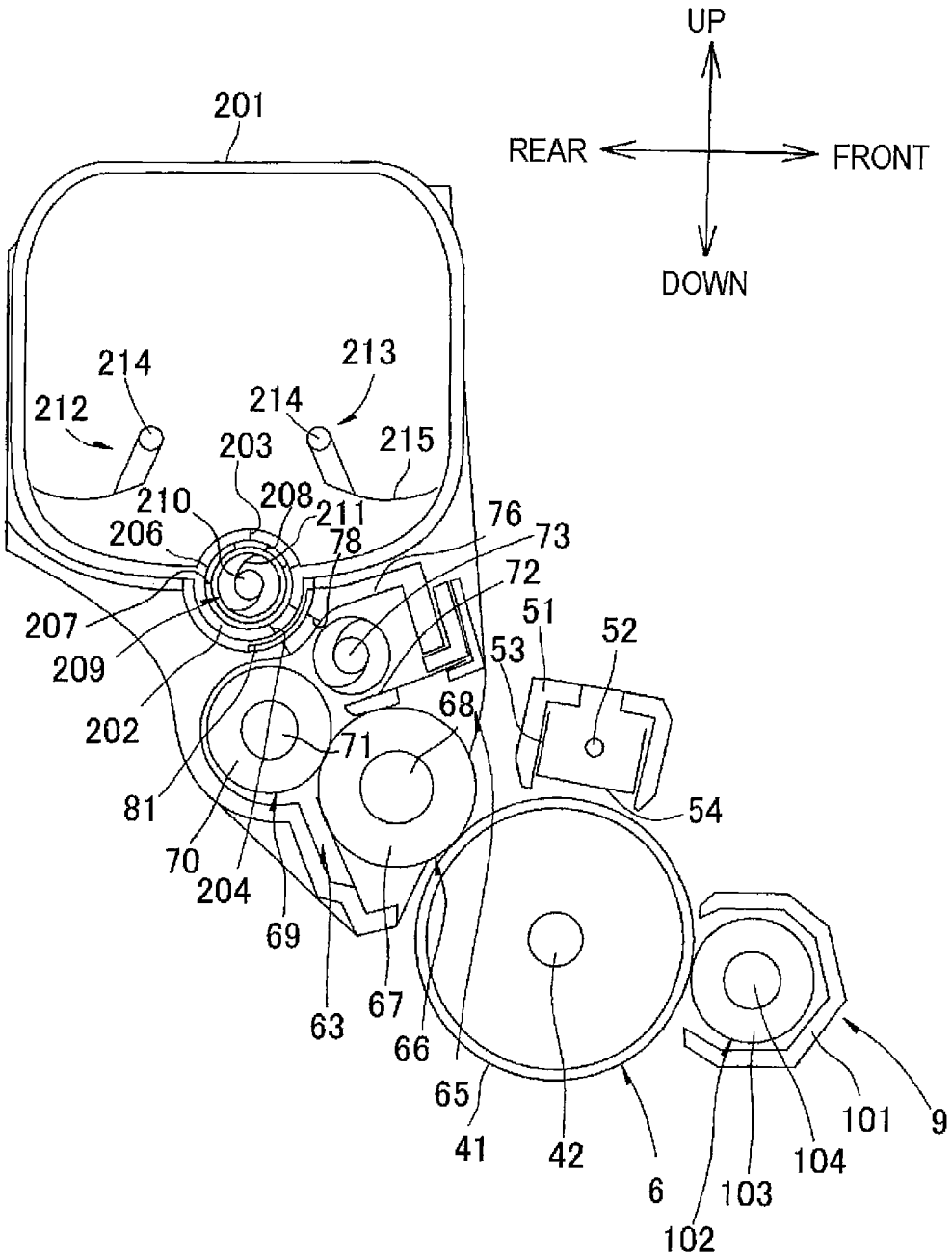
FIG. 24 is a cross-sectional view of the developing unit and the toner unit for yellow, magenta, or cyan, in which respective parts are in a closed position.

At this time, the developing-unit-side shutter 81 opposes and closes the through-holes 78, as shown in FIGS. 24 and 11, and the inner cylindrical body 206 opposes and closes the second outer-body-side supply through-holes 204 (see FIG. 20).

Figure 25:
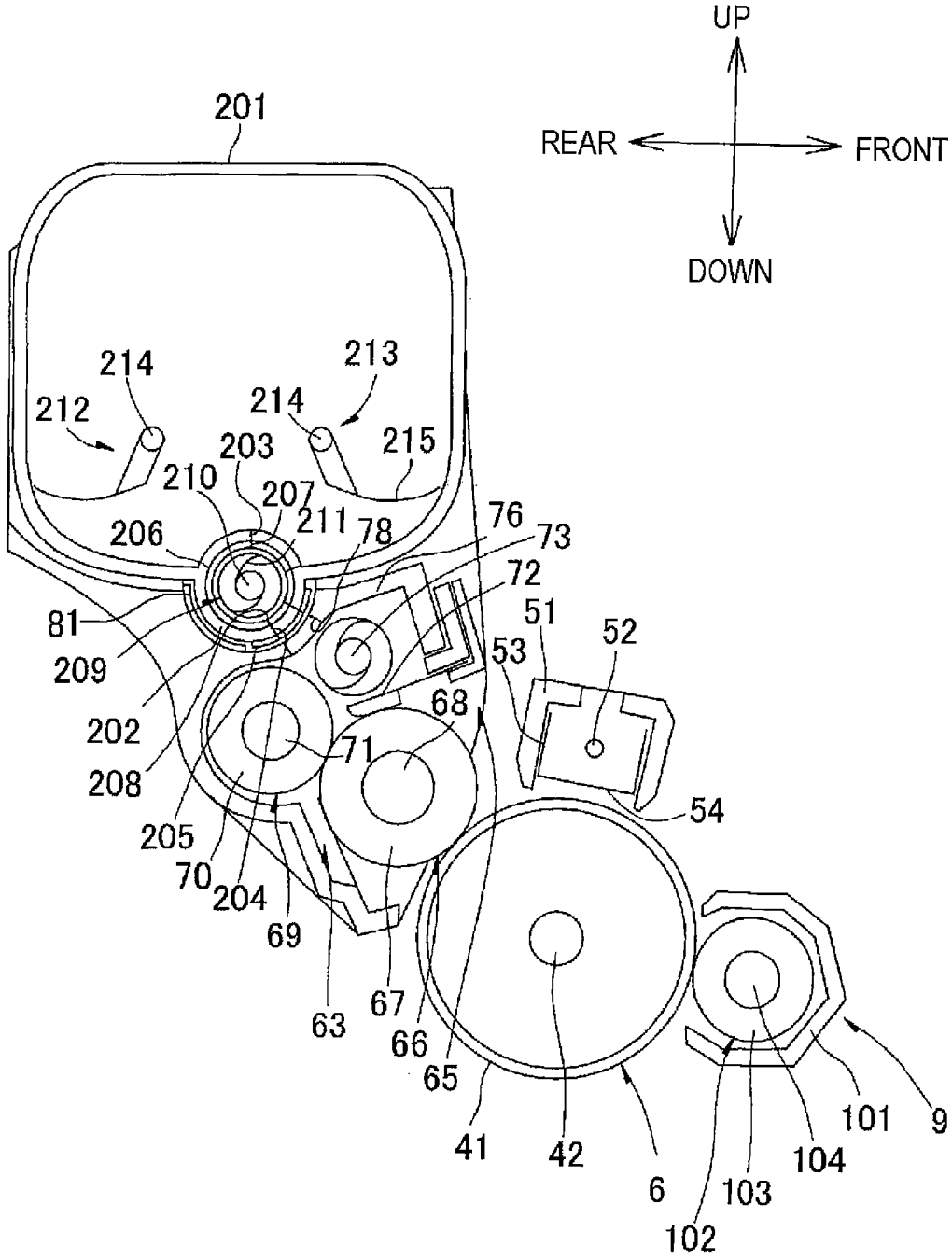
FIG. 25 is a cross-sectional view of the developing unit and the toner unit for yellow, magenta, or cyan, in which the respective parts are in an open position.

From this state, the user grips the operating knob 98 and rotates the manual operating member 95 approximately 90 degrees clockwise in a left side view until the operating knob 98 is aligned in the front-to-rear direction, as shown in FIG. 5. As the manual operating member 95 rotates, the shutter operating member 80 also rotates about 90 degrees clockwise in a left side view, moving the developing-unit-side shutter 81 to a position not confronting the through-holes 78, as shown in FIG. 12. The left and right enclosing plates rotate about 90 degrees clockwise in a left side view, and the inner cylindrical body 206 rotates about 90 degrees clockwise together with the left and right enclosing plates. Through this operation, the first inner-body-side supply through-hole 207 and second inner-body-side supply through-holes 208 formed in the inner cylindrical body 206 respectively oppose the first outer-body-side supply through-hole 203 and second outer-body-side supply through-holes 204, as shown in FIGS. 21 and 25.

As a result, the developing chamber 63 of the developing unit 8 is in communication with the interior of the case 201 of the toner unit 11 via the through-holes 78, second outer-body-side supply through-holes 204, second inner-body-side supply through-holes 208, internal space of the inner cylindrical body 206, first inner-body-side supply through-hole 207, and first outer-body-side supply through-hole 203.

This completes the operation for mounting the toner unit 11 for each of yellow, magenta, and cyan in the corresponding mounting space 64.

To remove a toner unit 11 from the corresponding mounting space 64, the operation for mounting the toner unit 11 in the mounting space 64 is performed in reverse.

5. Supplying Toner

After the toner units 11 are mounted in the corresponding mounting spaces 64, the drawer unit 3 is inserted to the accommodated position inside the main casing 2 and the front cover 4 is closed. At this time, the toner units 11 begin supplying toner into the corresponding developing units 8.

In the black toner unit 11, the auger 164 and agitator 167 are rotated. The rotating agitator 167 supplies toner from the toner accommodating part 153 in the toner unit 11 into the inner cylindrical body 159. The rotating auger 164 conveys toner received in the inner cylindrical body 159 toward the center of the inner cylindrical body 159 in left and right directions so that the toner is supplied into the developing chamber 63 of the developing unit 8 primarily through the center second inner-body-side supply through-hole 161 and center second outer-body-side supply through-hole 157.

In the toner unit 11 for each of yellow, magenta, and cyan, the auger 209 and agitators 212 and 213 are rotated. The rotating agitators 212 and 213 supply toner from the case 201 of the toner unit 11 into the inner cylindrical body 206. The rotating auger 209 conveys toner received in the inner cylindrical body 206 toward the center of the inner cylindrical body 206 in left and right directions so that the toner is supplied into the developing chamber 63 of the developing unit 8 primarily through the center second inner-body-side supply through-hole 208 and center second outer-body-side supply through-hole 204.

Toner supplied into the developing chamber 63 is conveyed in left and right directions by the rotating auger 73 so as to be distributed. The rotating supply roller 69 supplies toner from the supply roller 69 (the main supply roller body 70) to the developing roller 66 (the main developing roller body 67). The rotating developing roller 66 then conveys toner supplied thereon under the free end of the thickness-regulating blade 72. The thickness-regulating blade 72 regulates the thickness of the toner carried on the developing roller 66 to a thin layer. During image formation, the peripheral surface of the developing roller 66 (the main developing roller body 67) is in contact with the surface of the photosensitive drum 6. Accordingly, toner carried on the developing roller 66 is supplied to the photosensitive drum 6 to develop a latent image formed on the surface of the photosensitive drum 6 into a toner image.

6. Recovering Waste Toner

Sometimes not all of the toner is transferred from the photosensitive drum 6 to the paper but remains on the surface of the photosensitive drum 6. During image formation, a cleaning bias is supplied to the drum cleaning roller 102 of each drum cleaner 9. The application of a cleaning bias cause residual toner (waste toner) on the surface of the photosensitive drum 6 to be attracted to and temporarily retained on the drum cleaning roller 102. Following completion of the image-forming operation and prior to a succeeding image-forming operation, a bias of opposite polarity to the cleaning bias is supplied to the drum cleaning rollers 102 so that the waste toner retained on the drum cleaning roller 102 is returned to the surface of the corresponding photosensitive drum 6. Next, a bias is supplied to the primary transfer roller 17 so that the waste toner returned to the surface of the photosensitive drum 6 is attracted to the intermediate transfer belt 13.

Toner is also sometimes transferred from the photosensitive drum 6 to the intermediate transfer belt 13 during an image-forming operation.

Waste toner transferred to the intermediate transfer belt 13 is recovered by the belt cleaner 10. Specifically, a first cleaning bias and a second cleaning bias are respectively supplied to the primary belt cleaning roller 111 and secondary belt cleaning roller 112. When waste toner on the intermediate transfer belt 13 moves opposite the primary belt cleaning roller 111, the toner is attracted to the primary belt cleaning roller 111. The waste toner transferred onto the primary belt cleaning roller 111 is subsequently attracted to the secondary belt cleaning roller 112. When the waste toner carried on the secondary belt cleaning roller 112 rotates against the scraper 119, the waste toner is scraped off the secondary belt cleaning roller 112 by the scraper 119 and falls into the waste toner conveying chamber 117.

The auger 120 rotates within the waste toner conveying chamber 117. As shown in FIG. 13, the auger 120 conveys waste toner in the waste toner conveying chamber 117 to the left-to-right center in the waste toner conveying chamber 117, thereby conveying the waste toner into the waste toner conveying chamber 134 of the rear conveying unit 131.

The toner conveying belt 137 circulates (rotates) within the waste toner conveying chamber 134. More specifically, the auger shaft 121 and the belt shaft 135 are driven to rotate in synchronization with each other to circulate the toner conveying belt 137. Accordingly, waste toner conveyed to the waste toner conveying chamber 134 is carried upward by the protrusions 136 formed on the toner conveying belt 137 as the toner conveying belt 137 circulates. The waste toner carried to the upper end of the waste toner conveying chamber 134 passes sequentially through the through-hole 139 formed in the rear conveying unit 131, the external communication through-hole 177 formed in the main body part 172 of the upper conveying member 171, and the opening 180 in the shutter 178 and flows into the shutter 178.

The auger 184 is rotating inside the shutter 178 and conveys waste toner in the shutter 178 toward the center of the shutter 178 in the left-to-right direction. Waste toner conveyed to the center of the shutter 178 flows into the connecting part 173 through the opening 179 formed in the shutter 178 and the internal communication through-hole 176 formed in the main body part 172. This waste toner passes through the connecting part 173 and is collected in the waste toner accommodating part 154. The rotating auger 189 disposed in the waste toner accommodating part 154 conveys waste toner introduced into the waste toner accommodating part 154 toward both left and right sides.

7. Operations (1) As described above, the four photosensitive drums 6 are held by the drawer frame 5 such that the photosensitive drums 6 are juxtaposed at intervals in the front-to-rear direction in which the drawer frame 5 moves. The four photosensitive drums 6 are arranged spaced apart from one another by the prescribed gap in the drawer frame moving direction. The drawer frame 5 can move between the accommodated position inside the main casing 2 and the pulled-out position outside of the main casing 2.

The endless intermediate transfer belt 13 extending in the front-to-rear direction confronts the four photosensitive drums 6.

The four toner units 11 are held by the drawer frame 5. The toner units 11 are provided in one to one correspondence with the photosensitive drums 6. Each toner unit 11 has a toner accommodating unit which accommodates toner to be supplied to the corresponding photosensitive drum 6. The belt cleaner 10 is retained by the drawer frame 5 to remove waste toner to be discarded from the intermediate transfer belt 13 and to collect this toner. A waste toner conveying mechanism configured of the auger 120, rear conveying unit 131, and upper conveying member 171 conveys waste toner collected by the belt cleaner 10 to the waste toner accommodating part 154.

The waste toner accommodating part 154 is integrated with the toner accommodating part 153 of the black toner unit 11. The black toner unit 11 is one of the toner units 11 that is disposed on the rearmost side (most upstream side in the direction in which the drawer unit 3 is pulled out of the main casing 2) among the toner units 11. In other words, the black toner unit 11 is disposed on the rearmost end in the array of the toner units 11. When the toner accommodating part 153 runs out of toner, for example, the waste toner accommodating part 154 is replaced together with the toner accommodating part 153 (i.e., replaced with a toner accommodating part 153 accommodating toner and an empty waste toner accommodating part 154). Since the integrated toner accommodating part 153 and waste toner accommodating part 154 are retained in the drawer frame 5, these integrated members can be replaced with new members without having to move the intermediate transfer belt 13. Since the waste toner accommodating part 154 is replaced at least as often as the toner accommodating part 153 runs out of toner, it is not necessary to provide the waste toner accommodating part 154 with a very large capacity.

This configuration reduces the time and effort required for replacing the waste toner accommodating part 154. Further, since the waste toner accommodating part 154 does not require a large capacity, the color printer 1 can be made more compact.

The drawer frame 5 includes: the left side plate 31 and right side plate 32 that are disposed on left and right sides of the photosensitive drums 6 and that confront with each other along the left-to-right direction; and the rear beam 34 and front beam 33 that are disposed on rear and front sides of the four photosensitive drums 6 and that span between the left and right side plates 31, 32. The rear conveying unit 131 is provided on the rear beam 34. Hence, even though the drawer frame 5 has such a configuration that the drawer frame 5 can be moved, this configuration prevents the rear conveying unit 131 from interfering with the drawer frame 5 when the drawer frame 5 moves. Because the rear conveying unit 131 is provided on the rear beam 34 that is firmly fixed to the drawer frame 5, the user can easily couple the toner unit 11 to the rear conveying unit 131 when mounting the toner unit 11 to the drawer frame 5.

(2) The waste toner conveying mechanism includes: the auger 120 and the rear conveying unit 131 connected to the auger 120. The auger 120 receives, from the belt cleaner 10, waste toner collected by the belt cleaner 10 and conveys the waste toner to an inner side along the left-to-right direction. The rear conveying unit 131 receives waste toner from the auger 120 and conveys the waste toner upwardly toward the waste toner accommodating part 154. This configuration can efficiently convey waste toner upwardly.

(3) The rear conveying unit 131 is provided on a center region of the rear beam 34 in the left-to-right direction. So, the drawer frame 5 holding the rear conveying unit 131 has a good weight balance in the left-to-right direction. The drawer frame 5 can be moved smoothly.

(4) The waste toner conveying mechanism further includes the upper conveying member 171 that is disposed outside the waste toner accommodating part 154 and that is configured to couple the rear conveying unit 131 to the waste toner accommodating part 154. Waste toner conveyed by the rear conveying unit 131 can be introduced into the waste toner accommodating part 154 via the upper conveying member 171.

(5) The upper conveying member 171 has the main body part 172 and the connecting part 173. The main body part 172 is cylindrically shaped with its central axis oriented in the left-to-right direction and is connected to the rear conveying unit 131. The connecting part 173 extends from the main body part 172 in a direction orthogonal to the left-to-right direction and connects to the waste toner accommodating part 154. Waste toner conveyed by the rear conveying unit 131 is conveyed sequentially through the main body part 172 and connecting part 173 and is introduced into the waste toner accommodating part 154.

(6) The connecting part 173 is connected to the left-to-right center region of the waste toner accommodating part 154, preventing waste toner from collecting too much on one of the left and right sides of the waste toner accommodating part 154. Therefore, this construction can prevent the weight of the waste toner accommodating part 154 from becoming unbalanced left-to-right, enabling the developing roller 66 to confront the photosensitive drum 6 with good left-to-right balance.

(7) The connecting part 173 is connected to the waste toner accommodating part 154 so as to be capable of moving relative to the same. Accordingly, the connecting part 173 moves relative to the waste toner accommodating part 154 as the toner accommodating part 153 and waste toner accommodating part 154 move, maintaining the connection between the connecting part 173 and waste toner accommodating part 154.

Hence, when the black toner unit 11 is configured by integrating the waste toner accommodating part 154 and toner accommodating part 153, the connection between the waste toner accommodating part 154 and upper conveying member 171 can be maintained while allowing the integrated toner accommodating part 153 and waste toner accommodating part 154 to move. More specifically, the developing unit 8 and the toner unit 11 having the waste toner accommodating part 154 can follow oscillations by the photosensitive drum 6 to enhance printing quality. Because the connecting part 173 is disposed on the left-to-right center region of the waste toner accommodating part 154, a good left-to-right balance can be attained.

(8) The piston guide part 170 is formed in the waste toner accommodating part 154. The piston guide part 170 has a cylindrical shape with its central axis extending orthogonal to the left-to-right direction. The connecting part 173, which has a cylindrical shape with its central axis extending orthogonal to the left-to-right direction, is inserted into the piston guide part 170. Accordingly, when the toner accommodating part 153 and waste toner accommodating part 154 move, the piston guide part 170 moves relative to the connecting part 173 inserted therein.

The cylindrically-shaped sealing member 174 is interposed between the connecting part 173 and piston guide part 170 for sealing the gap therebetween. When the piston guide part 170 moves relative to the connecting part 173, the sealing member 174 prevents waste toner from leaking out through the gap between the connecting part 173 and piston guide part 170.

(9) The internal communication through-hole 176 is formed in the main body part 172 and communicates with the connecting part 173. The upper conveying member 171 is provided with the cylindrically-shaped shutter 178. The shutter 178 is capable of moving along the inner peripheral surface of the main body part 172 between an open position exposing the internal communication through-hole 176 and a closed position closing the internal communication through-hole 176. The operating lever 182 is coupled to the shutter 178. When the operating lever 182 is operated, the shutter 178 can be moved between the open position and closed position.

(10) The pair of guide parts 38 are provided in the main casing 2 to extend along the direction that the drawer frame 5 moves. The guided parts 35 are formed on the left and right side plates 31 and 32 constituting the drawer frame 5 and are guided by the guide parts 38 when the drawer frame 5 is moved. This structure enables the drawer frame 5 to be moved smoothly between the accommodated position and the pulled-out position.

(11) The auger 189 is disposed inside the waste toner accommodating part 154 to convey waste toner in directions toward both outer sides along the left and right directions. The waste toner introduced into the left-and-right center region of the waste toner accommodating part 154 is conveyed by the auger 189 from the left-to-right center region outwardly along the left-to-right direction. As a result, the amount of waste toner inside the waste toner accommodating part 154 can be made uniform in the left-to-right direction.

8-1. First Variation 1

In the above-described embodiment, the color printer 1 is of an intermediate transfer type. However, the color printer 1 may be modified to a color printer 301 of a direct transfer type shown in FIG. 26.

Figure 26:
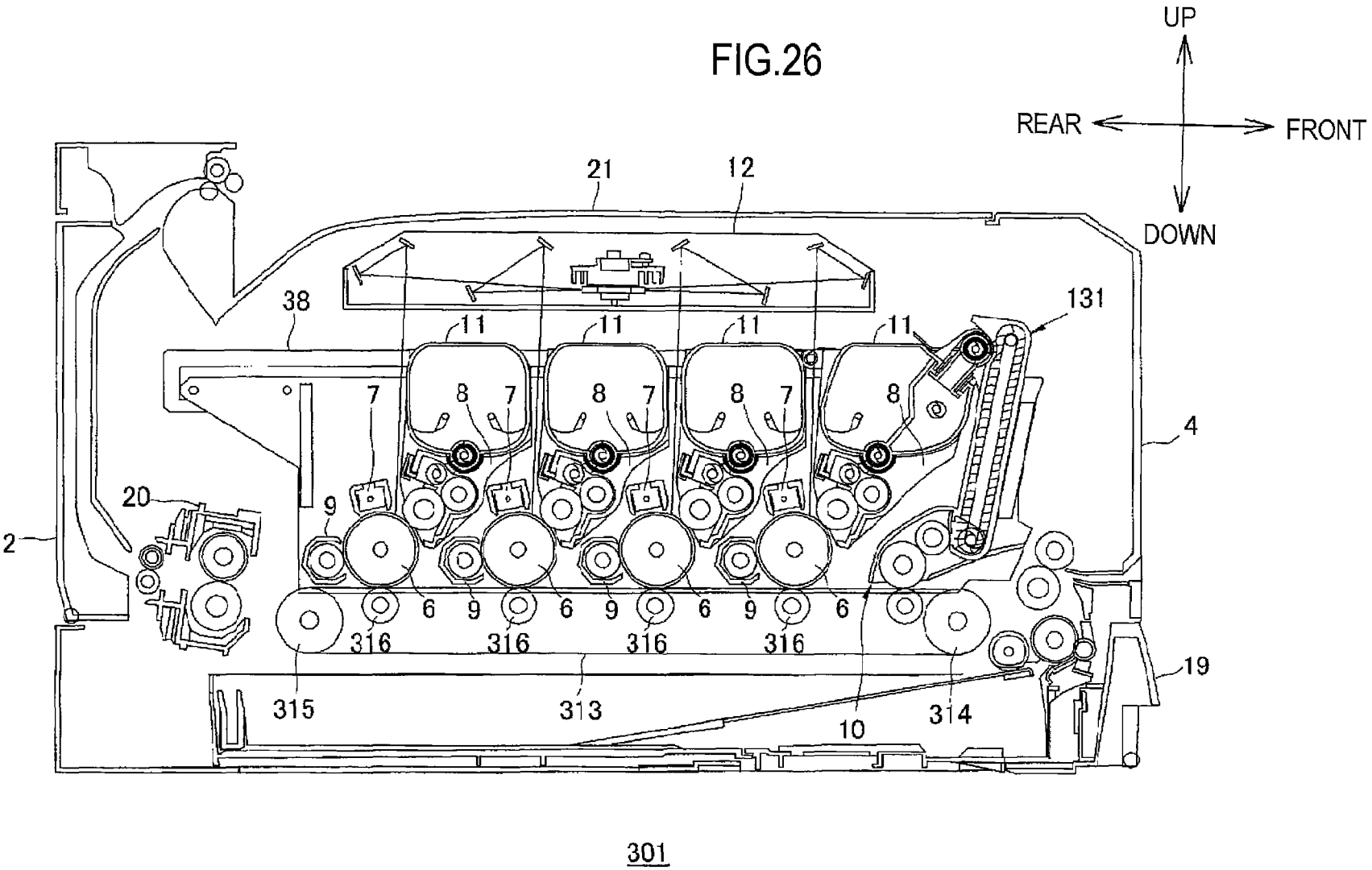
FIG. 26 is a cross-sectional view of a color printer according to a first variation.

In FIG. 26, the same or similar parts to those shown in FIG. 1 are referred to with the same or corresponding reference numerals.

In the color printer 301 of the direct transfer type, a sheet-conveying belt 313 is provided inside the main casing 2. The sheet-conveying belt 313 is an endless belt and is looped about two rollers 314 and 315. The rollers 314 and 315 are disposed in approximately the same vertical position, but are spaced apart in the front-to-rear direction. By placing the sheet-conveying belt 313 around the rollers 314 and 315, the upper portion of the belt loop between the top edges of the rollers 314 and 315 forms a flat portion that extends in both front-to-rear and left-to-right directions. This flat portion contacts the four photosensitive drums 6.

Transfer rollers 316 are disposed inside the loop of the sheet-conveying belt 313 at positions confronting corresponding photosensitive drums 6 through the flat portion of the sheet-conveying belt 313.

Various rollers are provided for conveying sheets of paper from the sheet cassette 19 onto the flat portion of the sheet-conveying belt 313. The sheet-conveying belt 313 then conveys the sheets of paper rearward sequentially through positions between the sheet-conveying belt 313 and each of the photosensitive drums 6.

During an image-forming operation, the sheet-conveying belt 313 circulates counterclockwise in a left side view. Toner images formed on the surfaces of the photosensitive drums 6 are sequentially transferred, beginning from the black toner image, and superposed on the sheet of paper conveyed by the sheet-conveying belt 313 through the function of the transfer rollers 316, forming a color toner image on the paper from the superposed toner images.

Sheets of paper are conveyed to the fixing unit 20 after toner images have been transferred onto the sheets. The fixing unit 20 fixes the toner images to the sheets of paper with heat and pressure. Once the toner images have been fixed in the fixing unit 20, various rollers discharge the sheets into the discharge tray 21 formed on the top surface of the main casing 2.

The belt cleaner 10 is disposed on the front side of a photosensitive drum 6 that is located at a front end of the array of the photosensitive drums 6 (forwardmost photosensitive drum 6). In this variation, the photosensitive drums 6 for the colors black, yellow, magenta, and cyan are arranged along the front-to-rear direction from the front to the rear according to the order of colors given above. So, the forwardmost photosensitive drum 6 is the photosensitive drum 6 for black. The rear conveying unit 131 is fixed to the rear side surface of the front beam 33 of the drawer frame 5. The belt cleaner 10 and the rear conveying unit 131 shown in FIG. 26 has a configuration symmetrical with the belt cleaner 10 and the rear conveying unit 131 shown in FIG. 1 relative to the front-to-rear direction.

8-2. Second Variation

Figure 27:
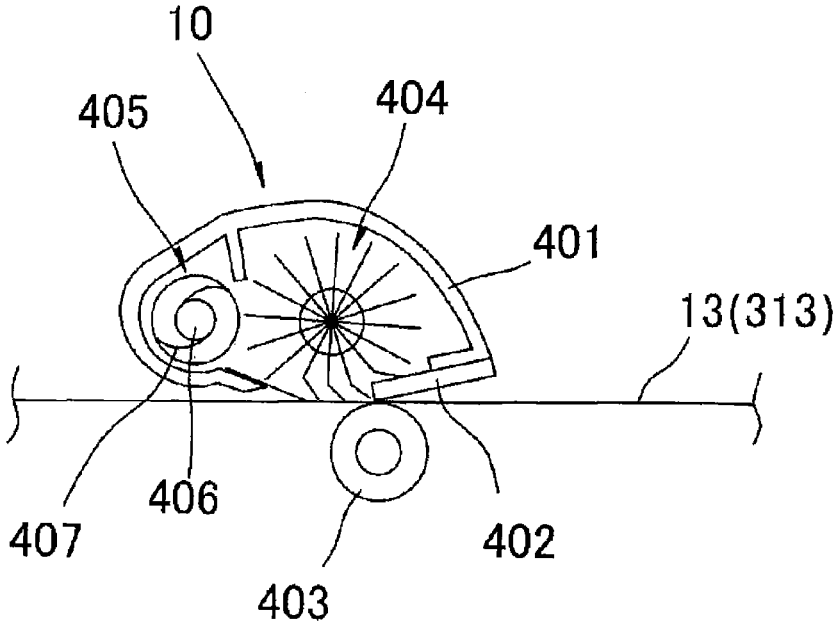
FIG. 27 is a cross-sectional view of a belt cleaner according to a second variation.

The belt cleaner 10 employed in the embodiment (FIGS. 1-25) may be modified to have the structure shown in FIG. 27. As shown in FIG. 27, the belt cleaner 10 includes a cleaner case 401.

The cleaner case 401 holds a rubber blade 402. The rubber blade 402 slopes toward the surface of the intermediate transfer belt 13 with the lower edge of the rubber blade 402 contacting the belt. A roller 403 is disposed at a position confronting the lower edge of the rubber blade 402 through the intermediate transfer belt 13.

A brush 404 is rotatably disposed in the cleaner case 401. The brush 404 rotates to scrub the surface of the intermediate transfer belt 13.

An auger 405 is disposed in the cleaner case 401 on one side of the brush 404 with respect to the front-to-rear direction. The auger 405 is configured of an auger shaft 406 oriented in the left-to-right direction, and an auger screw 407 that is formed in a helical shape around the circumference of the auger shaft 406. The portion of the auger screw 407 on the left half of the auger shaft 406 is wound in the direction opposite that on the right half.

The rotating brush 404 brushes waste toner off the intermediate transfer belt 13 and brings the toner into the cleaner case 401. The rotating auger 405 conveys waste toner introduced into the cleaner case 401 toward the left-to-right center of the cleaner case 401 to supply the waste toner into the waste toner conveying chamber 134 of the outer conveying unit 131 (see FIG. 6). Waste toner that passes the brush 404 without being brushed off the intermediate transfer belt 13 is subsequently scraped off by the rubber blade 402 downstream of the brush 404. The waste toner is lifted off the intermediate transfer belt 13 (becomes less adhesive) so that the brush 404 can brush the toner into the cleaner case 401.

The belt cleaner 10 employed in the first variation (FIG. 26) may also be modified to have the same structure as described above with reference to FIG. 27.

While the invention has been described in detail with reference to the embodiment and variations thereof, it would be apparent to those skilled in the art that various changes and modifications may be made therein without departing from the spirit of the invention.

What is claimed is:

1. An image-forming device, comprising:

a holding member;

a plurality of photosensitive drums that are held by the holding member, that are juxtaposed with one another in a prescribed direction, and that are arranged spaced apart from one another to form a row of photosensitive drums in the prescribed direction;

a plurality of developer material accommodating parts that are held by the holding member in one to one correspondence with the plurality of photosensitive drums so as to form a row of developer material accommodating parts in the prescribed direction and that are configured to accommodate developer material to be supplied to the photosensitive drums;

an endless belt extending in the prescribed direction and confronting all of the plurality of photosensitive drums at the same time;

a recovering unit that is held by the holding member and that is configured to remove, from the belt, waste developer material to be discarded from the belt and collect the waste developer material;

a waste developer material accommodating part that is configured to accommodate waste developer material collected by the recovering unit; and a waste developer material conveying mechanism that is configured to be connected to both of the recovering unit and the waste developer material accommodating part and to convey the waste developer material from the recovering unit to the waste developer material accommodating part, the holding member including:

a first side plate and a second side plate that are disposed on a pair of opposite sides of the photosensitive drums in an axial direction of the photosensitive drums and that confront with each other in the axial direction, the axial direction being orthogonal to the prescribed direction; and a first beam and a second beam that are disposed on a pair of opposite sides of the photosensitive drums in the prescribed direction and that span between the first and second side plates, the first and second beams extending parallel to the axial direction of the photosensitive drums, the first beam being disposed on an upstream side of the second beam in the prescribed direction, the waste developer material accommodating part being provided integrally with a most upstream developer material accommodating part in the row of the developer material accommodating parts in the prescribed direction, at least part of the waste developer material conveying mechanism being fixed to the first beam extending parallel to the axial direction of the photosensitive drums.

2. The image-forming device as claimed in claim 1, wherein the waste developer material conveying mechanism includes:

a first conveying member that is configured to receive, from the recovering unit, waste developer material collected by the recovering unit and to convey the waste developer material to an inner side along the axial direction of the photosensitive drums; and a second conveying member that is configured to receive waste developer material from the first conveying member and to convey the waste developer material to the waste developer material accommodating part.

3. The image-forming device as claimed in claim 2, wherein the second conveying member is provided on a center region of the first beam along the axial direction.

4. The image-forming device as claimed in claim 2, wherein the waste developer material conveying mechanism further includes a third conveying member that is disposed outside the waste developer material accommodating part and that is configured to couple the second conveying member to the waste developer material accommodating part.

5. The image-forming device as claimed in claim 4, wherein the third conveying member includes:

a main body part that is configured to be connected with the second conveying member; and a connecting part that extends from the main body part in a direction orthogonal to the axial direction and connects to the waste developer material accommodating part.

6. The image-forming device as claimed in claim 5, wherein the connecting part is connected to a center region of the waste developer material accommodating part along the axial direction.

7. The image-forming device as claimed in claim 5, wherein the connecting part is connected to the waste developer material accommodating part and is configured to move relative to the waste developer material accommodating part.

8. The image-forming device as claimed in claim 7, wherein the waste developer material accommodating part is formed with a piston guide part that has a cylindrical shape with its central axis extending orthogonal to the axial direction, the connecting part has a cylindrical shape with its central axis extending orthogonal to the axial direction, and is inserted into the piston guide part, and a sealing member of a cylindrical shape is interposed between the connecting part and the piston guide part.

9. The image-forming device as claimed in claim 5, wherein the main body part is cylindrically shaped with its central axis oriented in the axial direction, and wherein the main body part is formed with a through-hole that is in fluid communication with the connecting part, and the third conveying member includes:

a shutter that is configured to move along an inner peripheral surface of the main body part between an open position opening the through-hole and a closed position closing the through-hole; and an operating lever that is configured so as to be operated to move the shutter between the open position and closed position.

10. The image-forming device as claimed in claim 2, further comprising a main casing, the holding member being configured to move horizontally in the prescribed direction from an accommodated position, in which the holding member is accommodated inside the main casing, to a pulled-out position, in which part of the holding member is pulled outside of the main casing.

11. The image-forming device as claimed in claim 10, further comprising a pair of guide parts that are provided in the main casing, that are disposed on both sides along the axial direction and extend along the prescribed direction, the accommodated position being located between the pair of guide parts; and a pair of guided parts that are formed on the first and second side plates and that are configured to be guided by the guide parts when the holding member is moved.

12. The image-forming device as claimed in claim 10, wherein the second conveying member extends upwardly from the first conveying member.

13. The image-forming device as claimed in claim 1, further comprising a conveying member that is disposed inside the waste developer material accommodating part and is configured to convey waste toner in an inside of the waste developer material accommodating part in directions toward both outer sides along the axial direction.

* * * * *